US005194679A

United States Patent [19]

Cohen

[11] Patent Number: 5,194,679

[45] Date of Patent: Mar. 16, 1993

[54] MULTIPLE GUITAR TREMELO METHOD AND APPARATUS

[76] Inventor: Ian G. Cohen, 247 Pinehurst Ave., Los Gatos, Calif. 95032

[21] Appl. No.: 741,095

[22] Filed: Aug. 6, 1991

[51] Int. Cl.[5] ..... G10D 3/12

[52] U.S. Cl. ..... 84/313

[58] Field of Search ..... 84/313, 739, 740, 743, 84/298, 299, 307

[56] References Cited

U.S. PATENT DOCUMENTS

| | | | |
|---|---|---|---|
| 3,250,167 | 5/1966 | Porter | 84/313 |
| 4,141,271 | 2/1979 | Mullen | 84/312 |
| 4,171,661 | 10/1979 | Rose | 84/313 |
| 4,354,471 | 10/1982 | Glaser, II | 84/312 |
| 4,383,466 | 5/1983 | Shibuya | 84/313 |
| 4,457,201 | 7/1984 | Storey | 84/313 |
| 4,497,236 | 2/1985 | Rose | 84/298 |
| 4,782,732 | 11/1988 | Kato et al. | 84/313 |
| 4,852,448 | 8/1989 | Hennessey | 84/313 |

*Primary Examiner*—William M. Shoop, Jr.
*Assistant Examiner*—Jeffrey W. Donels
*Attorney, Agent, or Firm*—Allston L. Jones

[57] ABSTRACT

A method and apparatus is disclosed for use with tremelo devices. The method and device incorporate the use of 2, 3, or 6 tremelo device base plates with anchoring means to anchor each of the tremelo device base plates to the face of the guitar at a tilt point in such manner that there is no movement allowed other than the normally desired tremelo tilting movement. This is accomplished by utilization of special anchoring means, and means to return the tremelo devices to their original starting positions when being inactivated. The present invention also discloses several means for joining the individual base plates in various groupings or all together to provide the guitarist with the maximum degree of control over the sounds producable by a guitar that is so equipped.

2 Claims, 26 Drawing Sheets 51
52
54
55
60
61
62
58
59
57
56
53
50
4
10
10a
13
70-82
85-97
16
15
18
17
4
11
100
19
20

MULTIPLE GUITAR TREMELO METHOD AND APPARATUS

BACKGROUND OF THE INVENTION

1. Field of the Invention

This invention is in the general field of musical instruments, is more particularly directed to a stringed instrument with a neck, and even more particularly is directed to a method and means for associating a tremelo device with a guitar and with guitar strings in such manner that the tremelo device is split in half, thirds, and sixths and when activated may regulate high or low pitch simultaneously or separately, or control the pitch of all strings individually, or control different pitch combinations.

1. Description of the Prior Art

There are many tremelo devices known to those skilled in the guitar art. The tremelo devices take a number of different configurations. All tremelo devices, of whatever structure, have the common fault that they only allow simultaneous control of all of the strings of a guitar and all of their relative pitches.

It would be advantageous to have a tremelo device that would permit control of the strings in various combinations such as in half, thirds, or sixths. This would provide sound combinations that are not currently available. The present invention provides such a device.

SUMMARY OF THE INVENTION

Guitars are frequently fitted with, or originally include, a device known as a "tremelo" device. The purpose of the tremelo device is to allow a guitarist to alter an existing string tone, or existing string tones, by an increase or decrease of string tension. The tone changes are impressive and useful to a guitarist, but, when tremelo devices heretofore known are utilized, control of the high and low pitch sets of strings, pitch control of the pitch of all strings individually, and control of different combinations of strings cannot be achieved.

Basically, the tremelo device must be anchored to the face of the guitar, and the tremelo device includes either two, three or six bridges which also act as an end for the strings.

Normally, all tremelo devices will have movement, frequently of a complex nature, with relation to the face of the guitar. Particularly those devices which are so designed that they are utilizing a tremelo device base plate, allow for considerable complex movement, such as sliding or pivoting movement with relation to the original position. Additionally, the strings will actually move when the device is used and such movement will be longitudinal over both the nut and the bridge.

In view of the problems and circumstances as heretofore outlined, the present invention includes base plates for a tremelo device which are anchored in such manner that allows control over the high and low pitch strings separately or simultaneously, allows control over the pitch of all strings individually, and control of different combinations of strings with all base plates always returning to the position in which they were located prior to activation. A positive activating force must be utilized in order to move these base plates into any other positions.

In separate embodiments, the present invention utilizes two, three and six pairs of tapered slots at opposite and opposing sides of the tremelo devices together with screws, having shoulders which are affixed to the guitar face. Associated with this are two, three and six spring arrangements within the guitar which return the tremelo device base plates to their starting positions immediately after use in each instance.

In connection with the base plates, there is provided restraining arrangements for the base plates so that they can be joined together as one unit, joined in certain different combinations, or separated into two, three and six units and these restraining arrangements are directly associated with two, three or six tremelo device base plates.

By the combinations heretofore referenced, the result of controlling the high pitched and/or the low pitched strings, the pitch of all strings individually, control of different pitch combinations, control of all strings at all times, or control of several base plates, in different configurations, at the bridge end is accomplished.

DESCRIPTION OF PREFERRED EMBODIMENT

Figure 1A:
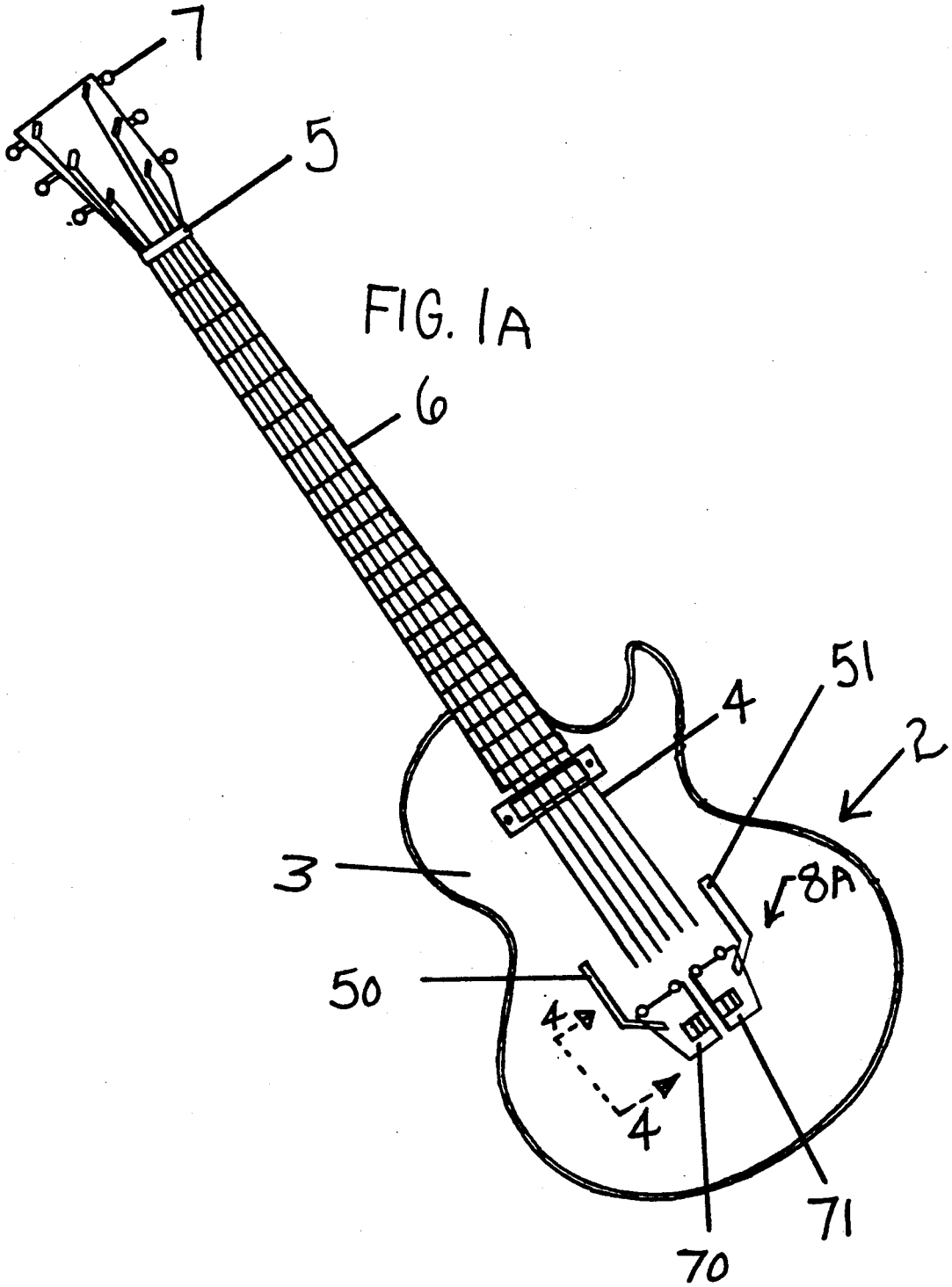
FIGS. 1A–1D are perspective views of a guitar utilizing a preferred embodiment of the present invention.

FIGS. 1A–1D show the general parts of a guitar. The guitar consists of a neck 6, the nut 5 and the body 2 having a sounding board or face 3, and the appropriate strings 4 with means 7 to tighten the strings. The particular embodiments shown in each of FIGS. 1A–1D have incorporated a different preferred embodiment of a tremelo device 8A–8D of the present invention.

Figure 1B:
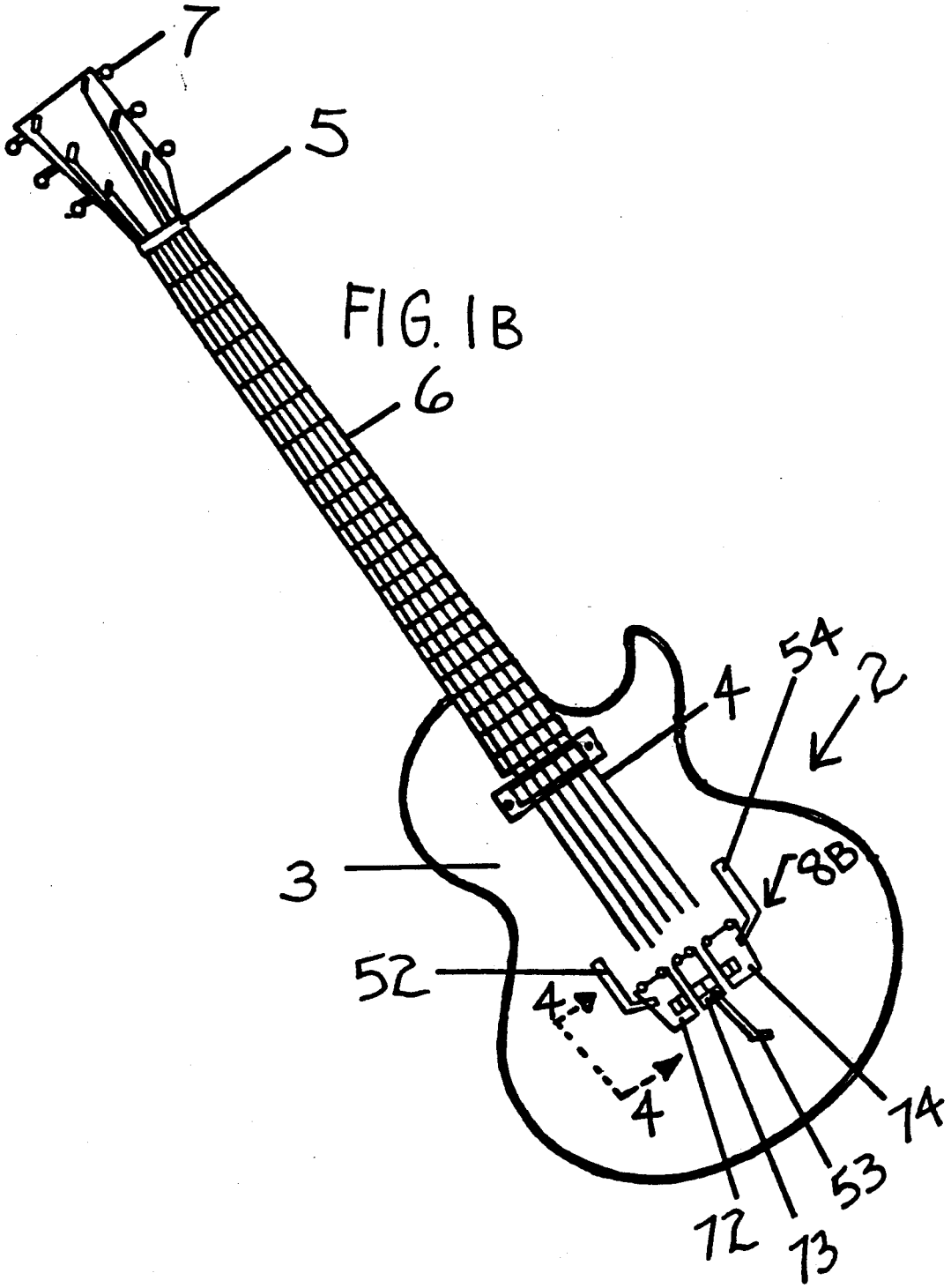
Figure 1C:
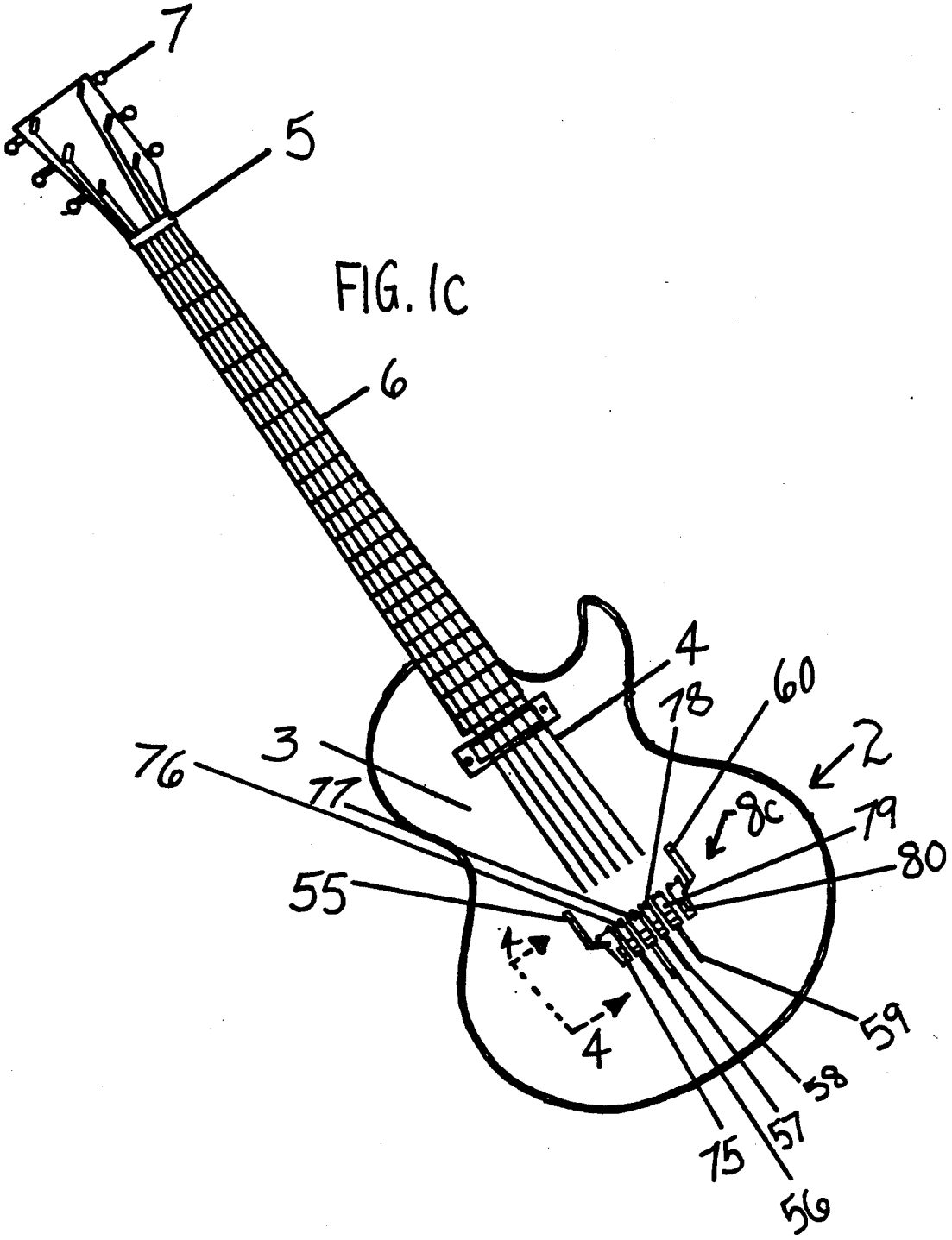
Figure 1D:
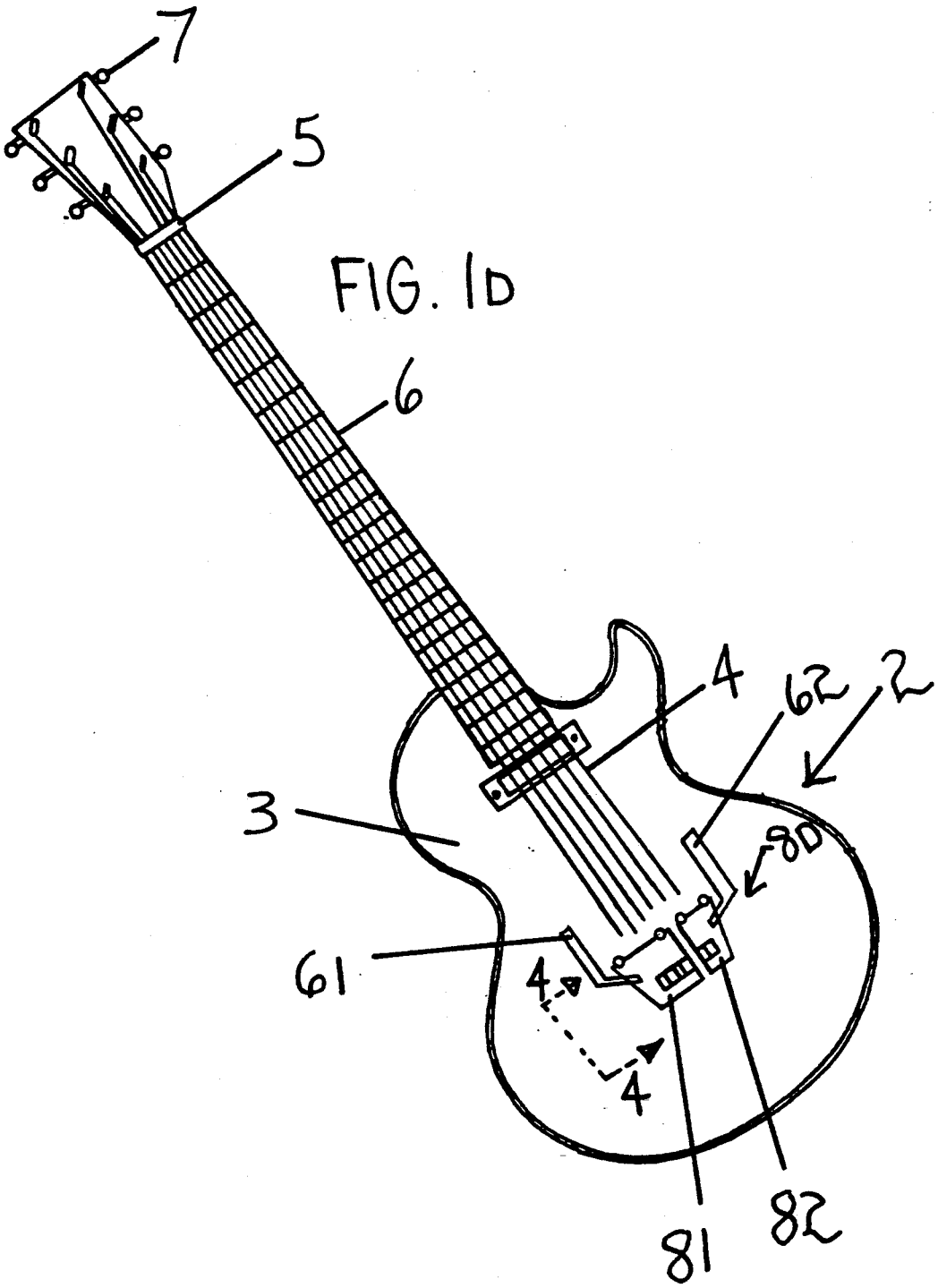
Figure 2A:
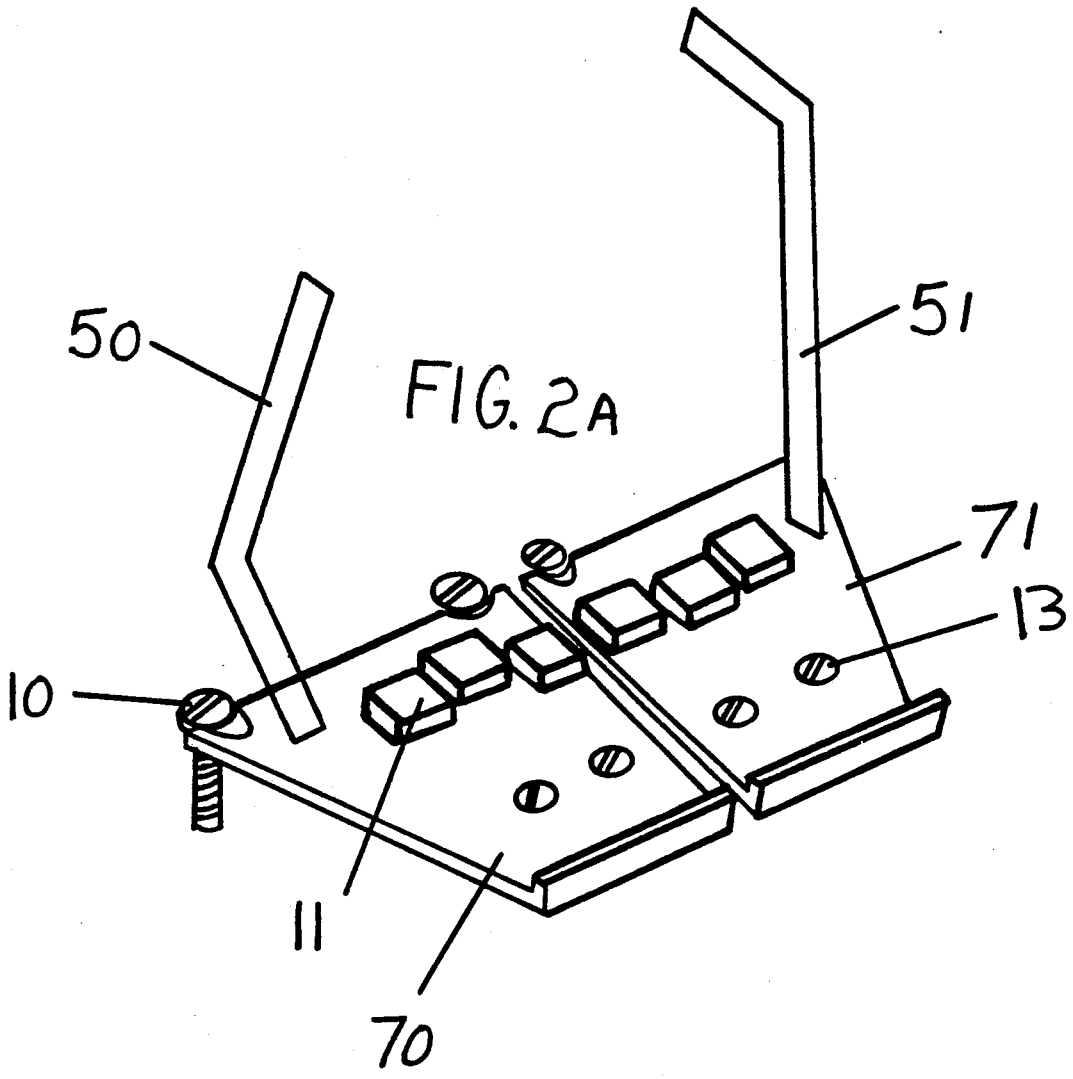
FIGS. 2A–2D are enlarged perspectives of a preferred embodiment of a tremelo device base plate and the bridge and string restraining assembly shown generally at 8 in FIGS. 1A–1D.
Figure 2B:
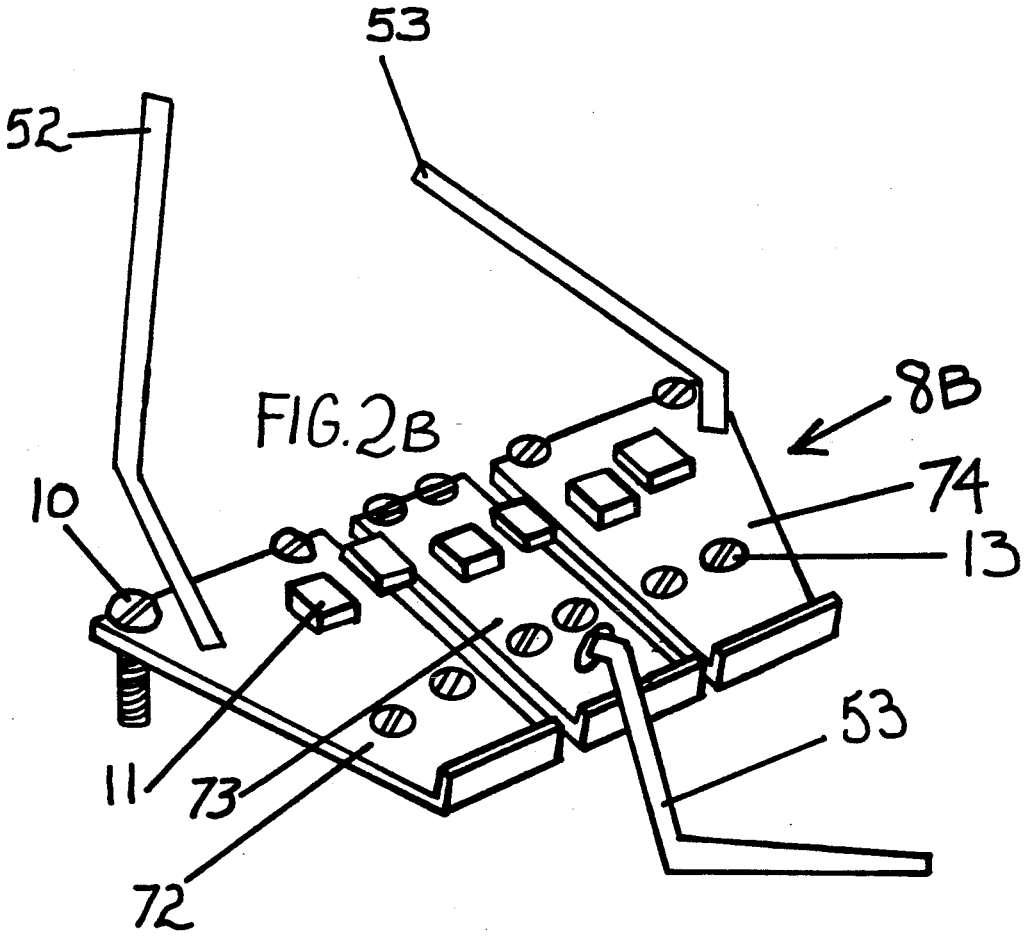
Figure 2C:
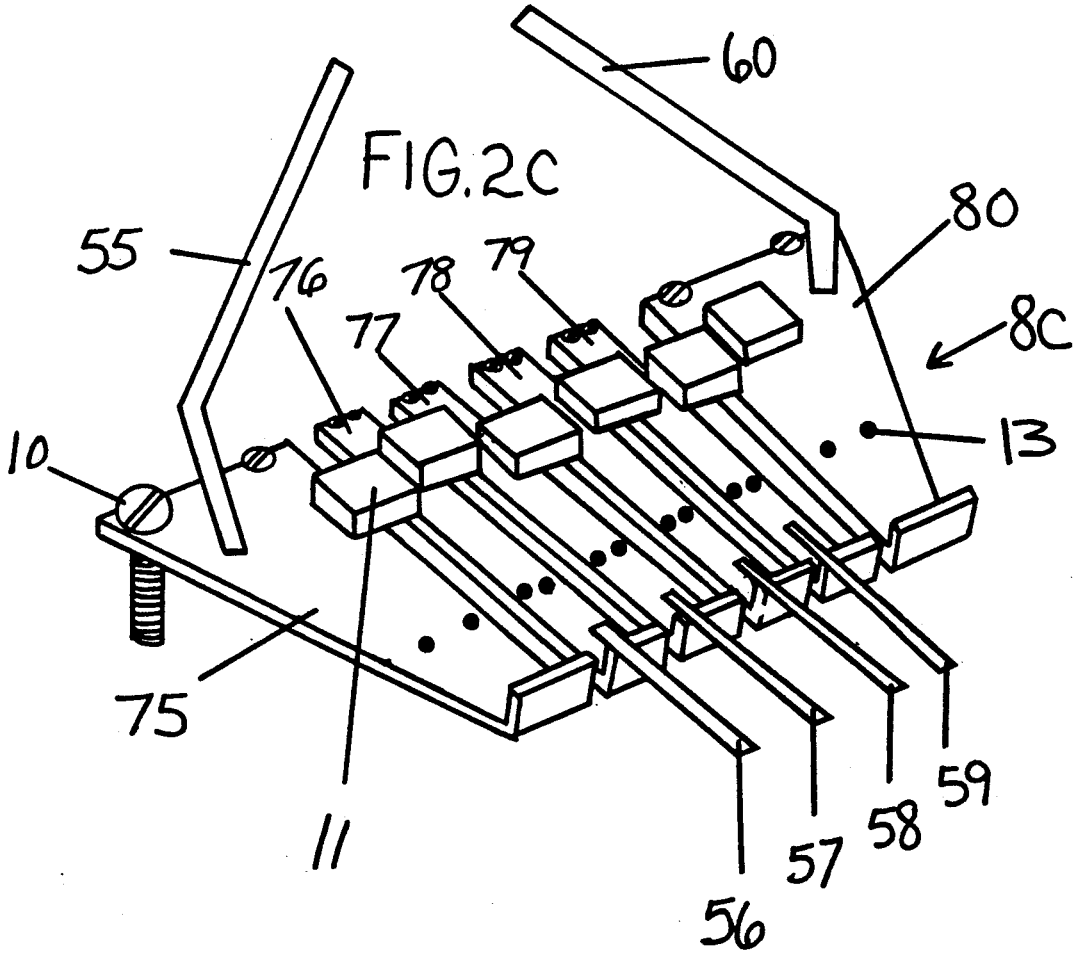
Figure 2D:
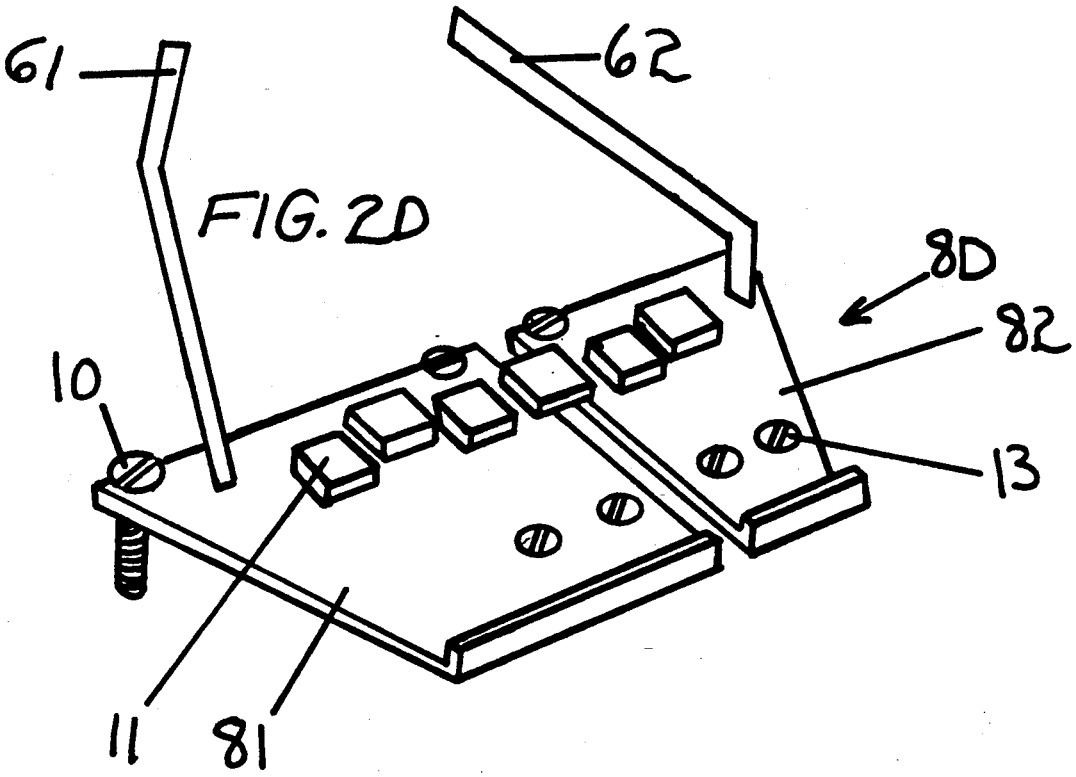
Figure 5A:
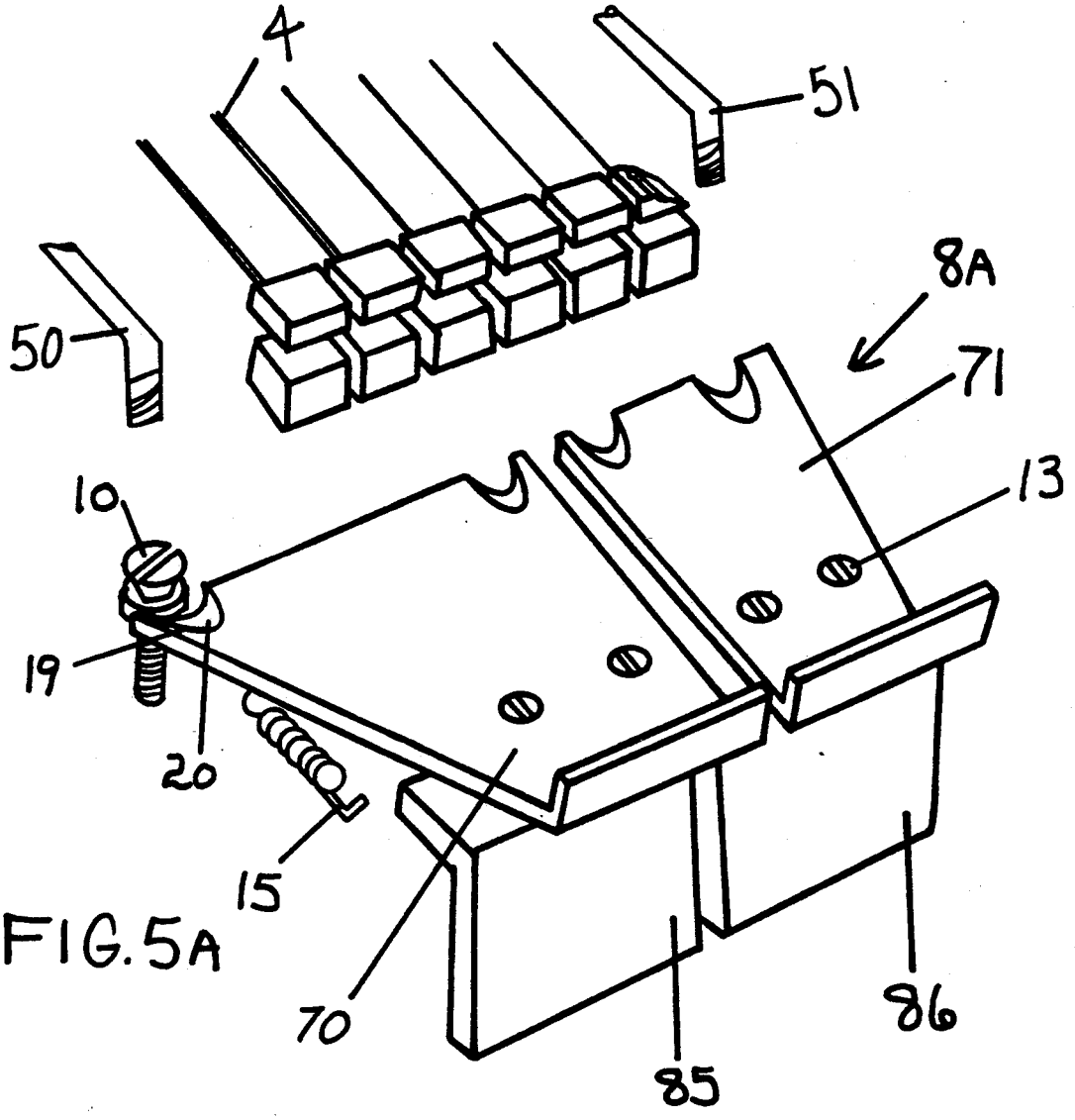
FIGS. 5A–5D are exploded views of the device of FIGS. 2A–2D.
Figure 5B:
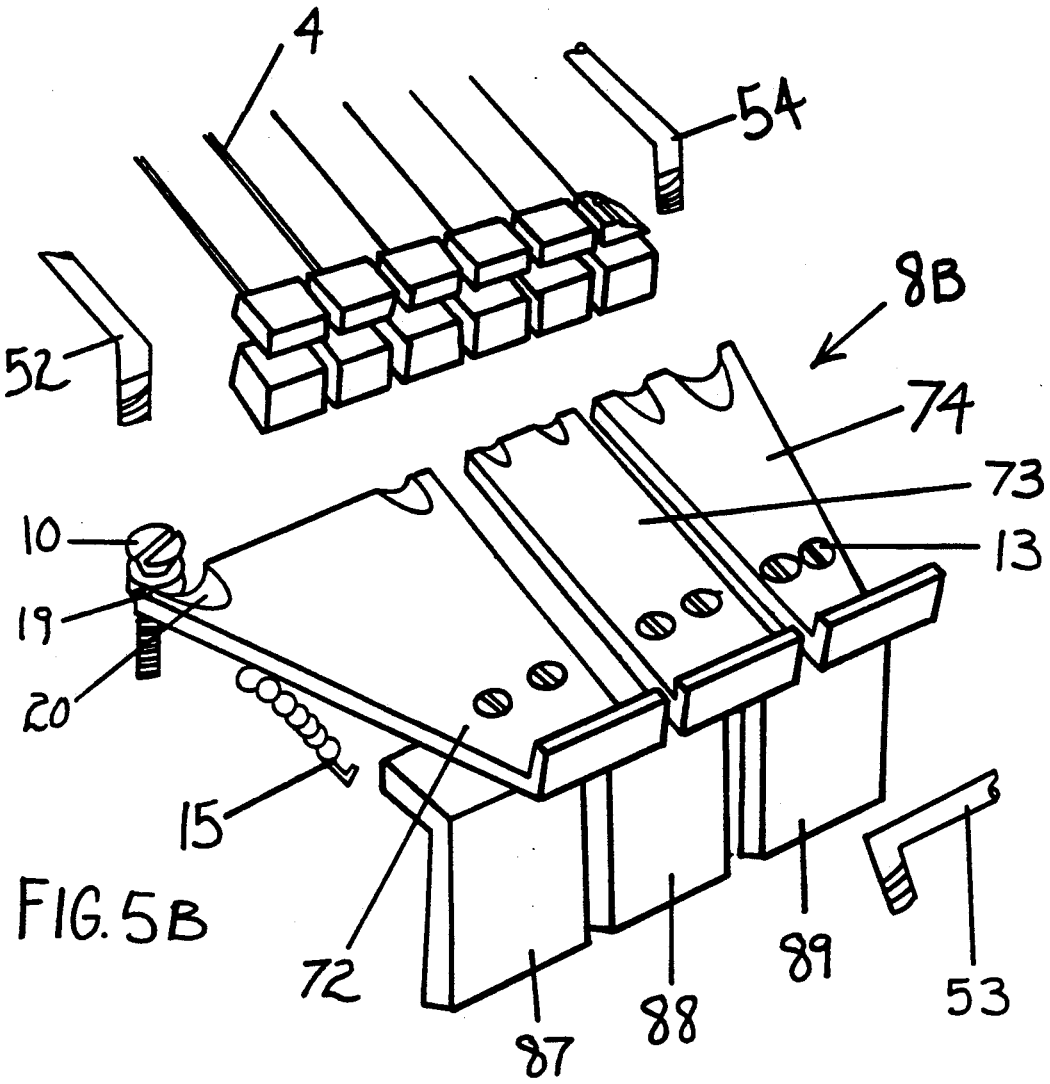
Figure 5C:
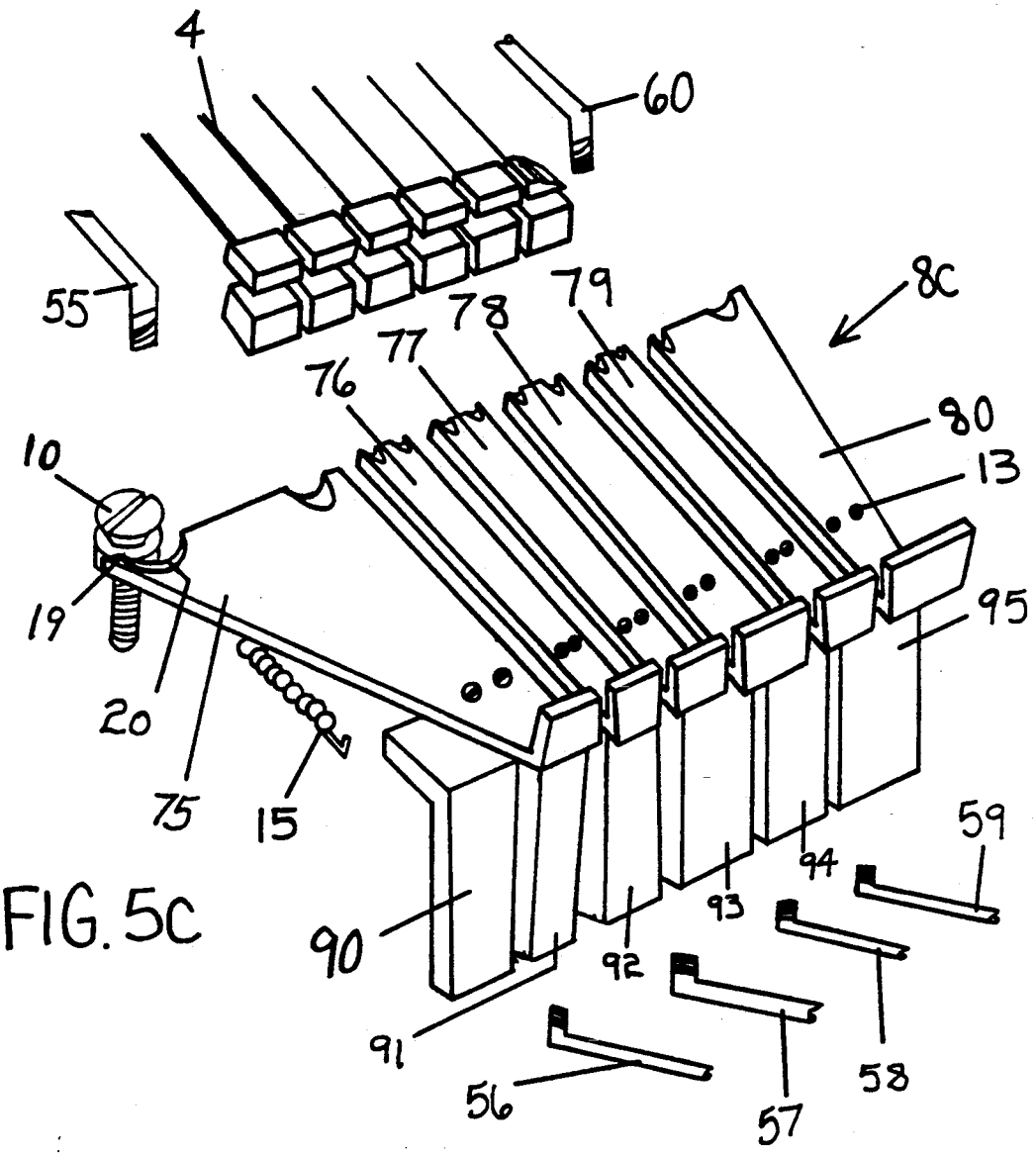
Figure 5D:
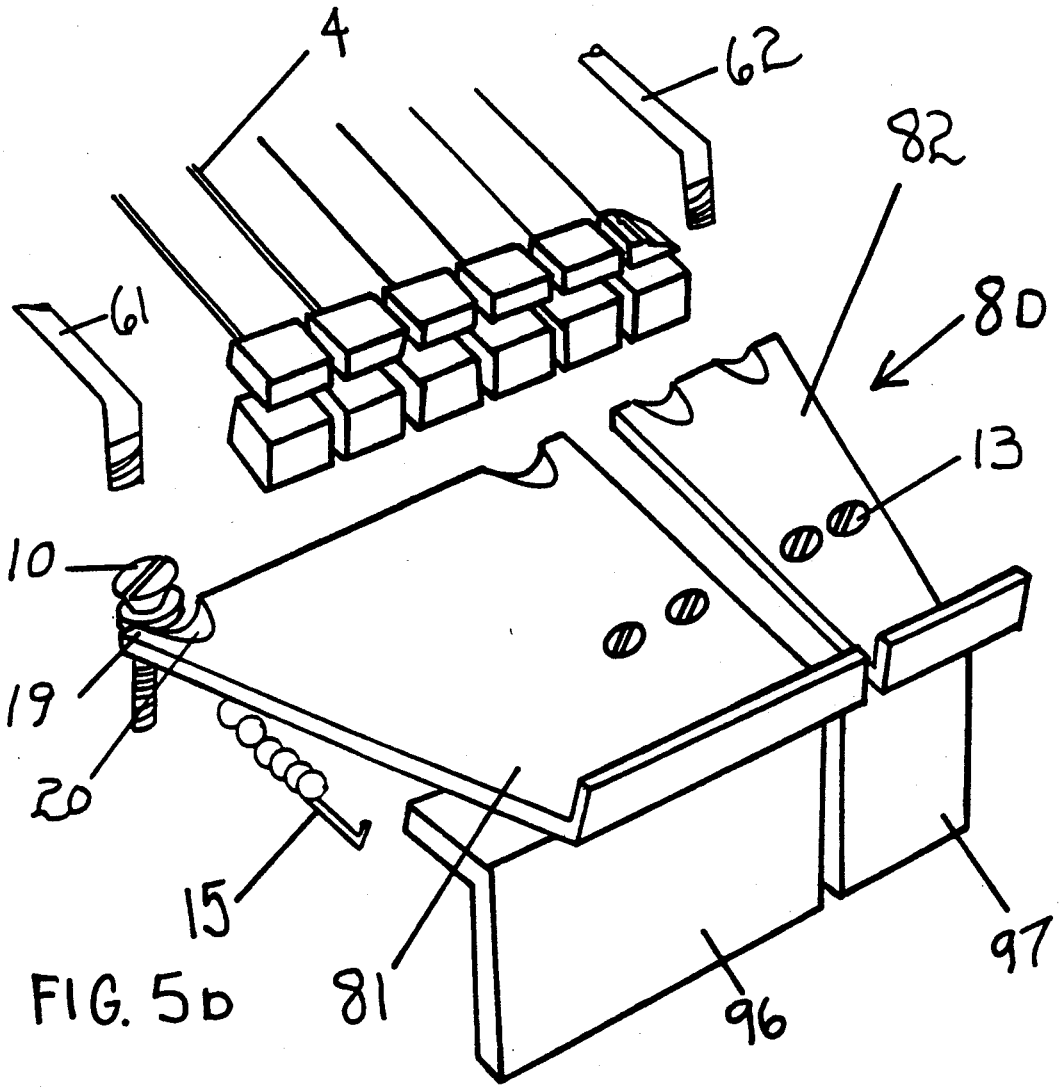

FIGS. 1A, 2A, and 5A show a device with two equal width base plates 70 and 71. FIGS. 1B, 2B, and 5B show a device with three equal width base plates 72, 73 and 74. FIGS. 1C, 2C, and 5C show a device with individual base plates 75, 76, 77, 78, 79 and 80, one for each string. FIGS. 1D, 2D, and 5D show a device with base plates 81 and 82 split in a $\frac{1}{3}$–$\frac{2}{3}$ format. Additionally, it should be noted that each of base plates 70–82 has associated with it its own tremelo activation lever 50–62, respectively.

Turning next to FIGS. 2A–2D, 3, 4, and 5A–5D, jointly, the particular embodiment of an apparatus to perform the method of the present invention is particularly illustrated. The various forms of the device of the present invention includes base plates 70–82, string restraining parts of blocks 11, tremelo activation levers 50–62, springs 15, guitar spring anchor means 17, and tremelo device spring arms 85–97. It will be observed that a pair of anchor screws 10 are used to mount each of base plates 70–82. Shoulders 19 are located in opposite corners of the forward edge of each base plate, with each of shoulders 19 held in a tapered slot 20 between the head of the screw 10 and the flanged shoulder 10*a*. The screws 10 may be screwed into bushings 18 having appropriate threads and appropriately held in a wooden block portion 16 within the body of the guitar as is particularly illustrated at FIG. 4. The springs 15 are strung between screw held anchors 17 or the like as shown, and holes or the like in the lower end of spring arms 85–97. The upper end of spring arms 85–97 are fastened beneath the corresponding tremelo base plates by screws 13, or could be formed integrally with the base plates, or by other appropriate means.

Figures 3, 4:
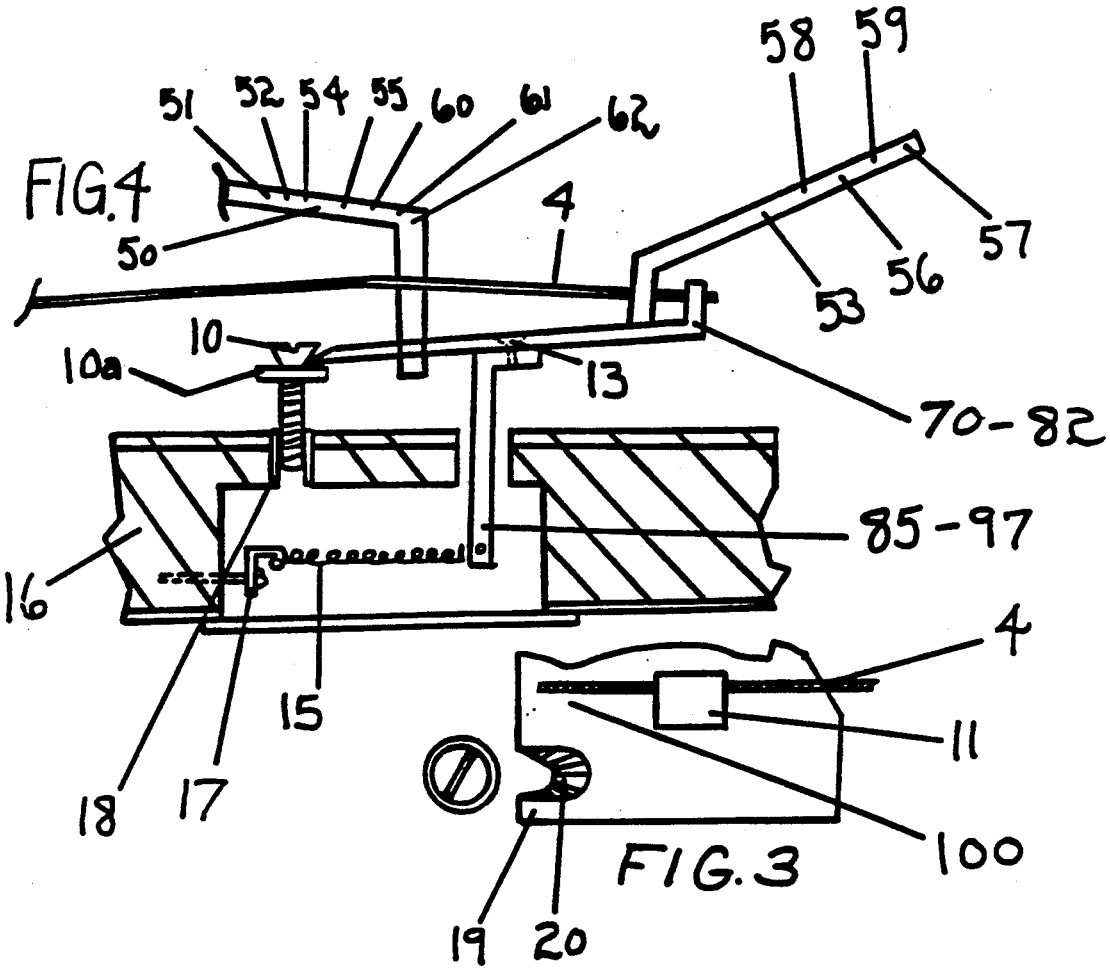
FIG. 3 is a partially exploded partial top view of each device and its base plate anchor point as utilized in the device of FIGS. 2A–2D.
FIG. 4 is an enlarged partial section on 4—4 of FIGS. 1A–1D.

FIGS. 3 and 4 particularly illustrate how the tapered slot 20 in shoulder 19 will fit with, and be appropriately held in positive anchor position upon, the screw 10 and between the head of the screw and the flange 10*a*. The tapering slot allows for the tilting motion necessary for proper activation.

As seen in FIG. 3, the area 100 between the string restraining parts of blocks 11 and the front edge of each of base plates 70–82 is necessary to allow the anchor screw means 10 to be located in such a manner that each base plate 70–82 may be held in a positive anchor position.

It is desirable to be able to swing the tremelo activation levers 50–62 outside of the playing area when not in use. It will be clear from the included figures that the tremelo activation levers 50–62 swivel by a screw arrangement having a nut and with a washer or the like therein. When the tremelo device is to be used, the tremelo activation levers 50–62 are swiveled into a position convenient for use by the guitarist. The normal position is for the tips of the tremelo activation levers 50–62 to be substantially over the strings and pointing toward the neck of the guitar. At this time, the guitarist may activate one or more of the tremelo activation levers 50–62 by either pressing downwardly or raising upwardly in any combination of these tremelo activation levers 50–62.

For example, the guitarist may grasp two, three, or four of the tremelo activation levers 50–62, may apply a positive activating force by raising the desired tremelo activation levers. The guitarist may also apply a positive activating force by pressing downwardly on the desired tremelo activation levers 50–62, simultaneously or separately. One, two or three tremelo activation levers 50–62 may also be grasped in the right hand while other of the tremelo activation levers 50–62 are activated by resting them on the inner forearm and applying a positive activating force. The guitarist may pull up on one or more of the tremelo activation levers 50–62, while depressing one or more other tremelo activation levers 50–62, and also not activating at least one other of the tremelo activation levers 50–62.

Such action, as will be clear to those skilled in the art, will cause a tilting about the head of screws 10. The tapered slot arrangement 20 allowing for this action against the head of screws 10 and being restrained by the shoulder 19. The tension on the strings pulls slots 20 of the base plates against the head of the screw 10, and, the springs 15 through the attaching arms 85–97 have an offsetting tension arrangement holding the tremelo device in such manner that it does not move upwardly except by the added pressure applied to the tremelo activation levers 50–62 during activation, and likewise, they will not move downward except when so activated in a downward direction.

The tapering of the slots 20 allows for free movement in the tilting direction. It also allows immediate return to prior tensioning and initial positioning of the strings when the tremelo device is deactivated.

FIGS. 6–13 show several methods in which one may rejoin the various base plates in each embodiment. A "joining method" is the practice one would use to rejoin several base plates as one unit or in several units as will be seen in the following discussions with respect to each of these methods.

Figure 6A:
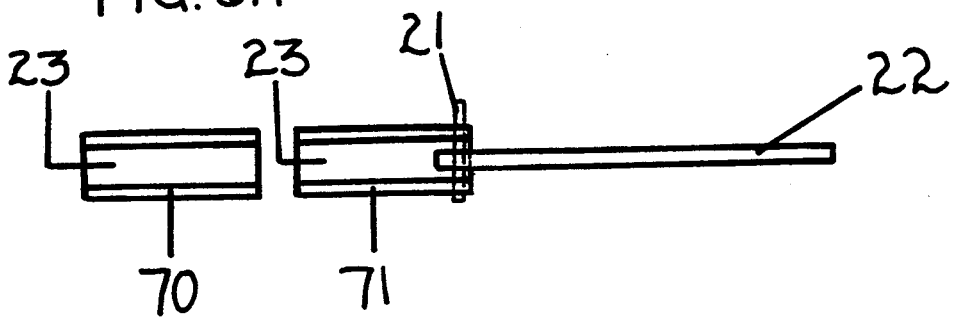
FIG. 6A is a rear view of an embodiment for a first joining method applied to two separate base plates.

Referring now to FIG. 6A, there is shown a rear view of base plates 70 and 71 of FIGS. 1A, 2A, and 5A and a first joining method. Base plates 70 and 71 each have a groove 23 that extends along the full width. The grooves 23 in base plates 70 and 71 are in alignment when there is no positive pressure applied to tremelo activation levers 70 and 71. Grooves 23 in the rear of base plates 70 and 71 are sized to accept joiner bar 22 which is rotatable around pin 21 to rest inside grooves 23 in base plates 70 and 71.

Figure 6B:
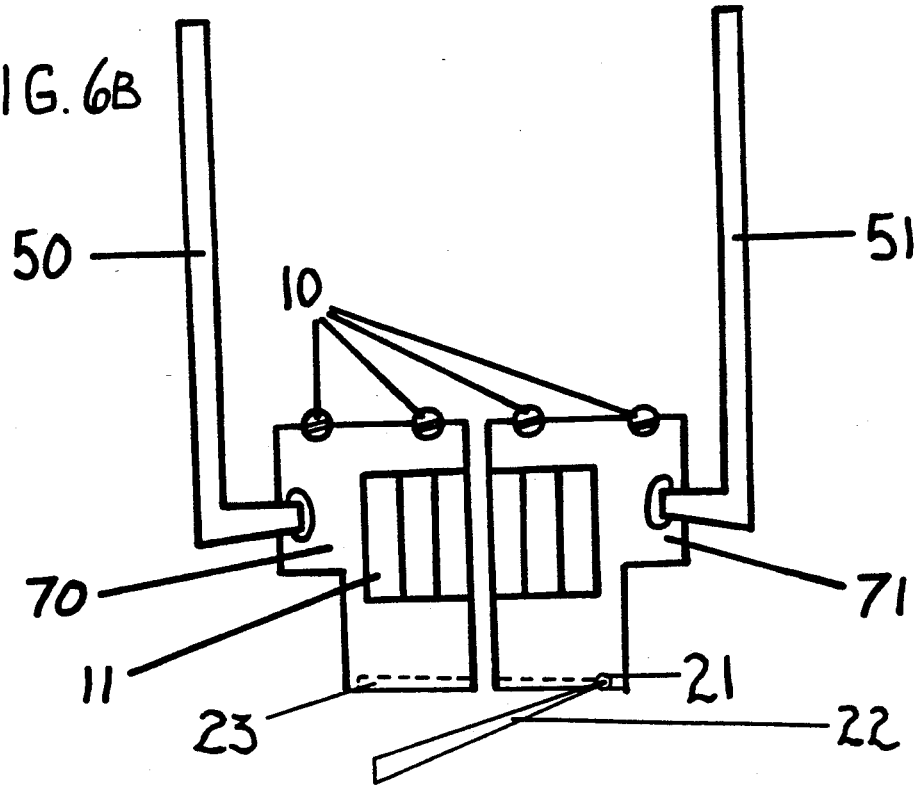
FIG. 6B is a top view of an embodiment for a first joining method applied to two separate base plates.

FIG. 6B shows a simplified top view of FIG. 2A. FIG. 6B further illustrates the use of joiner bar 22 to accomplish the first joining method as taught with respect to FIG. 6A. A positive activating force would be necessary to insert joiner bar 22 into the groove 23 to insure the accomplishment of the first joining method.

Figure 6C:
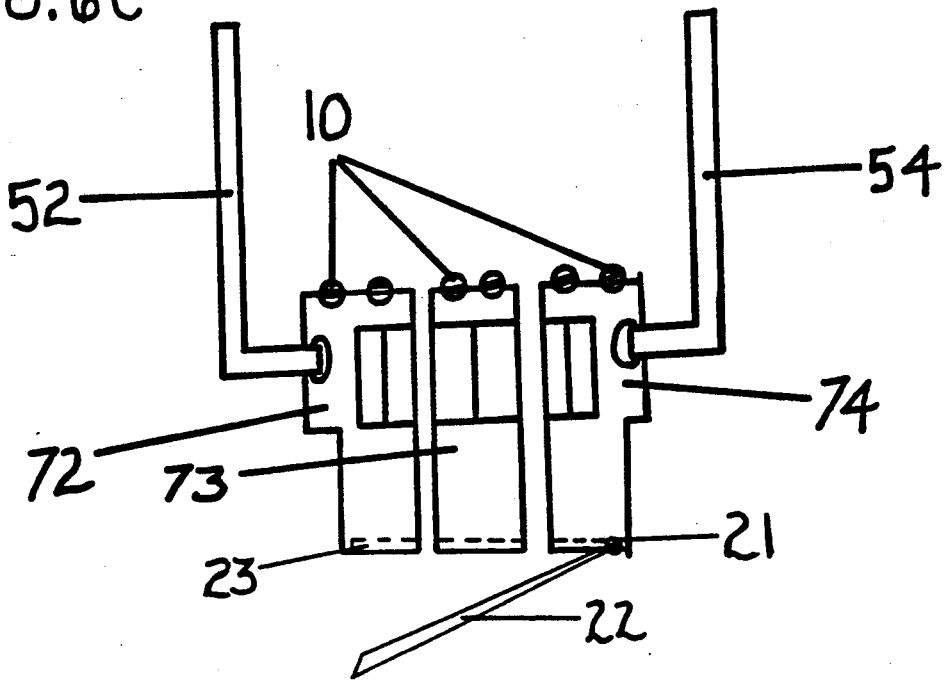
FIG. 6C is a top view of an embodiment for a first joining method applied to three separate base plates.
Figure 6D:
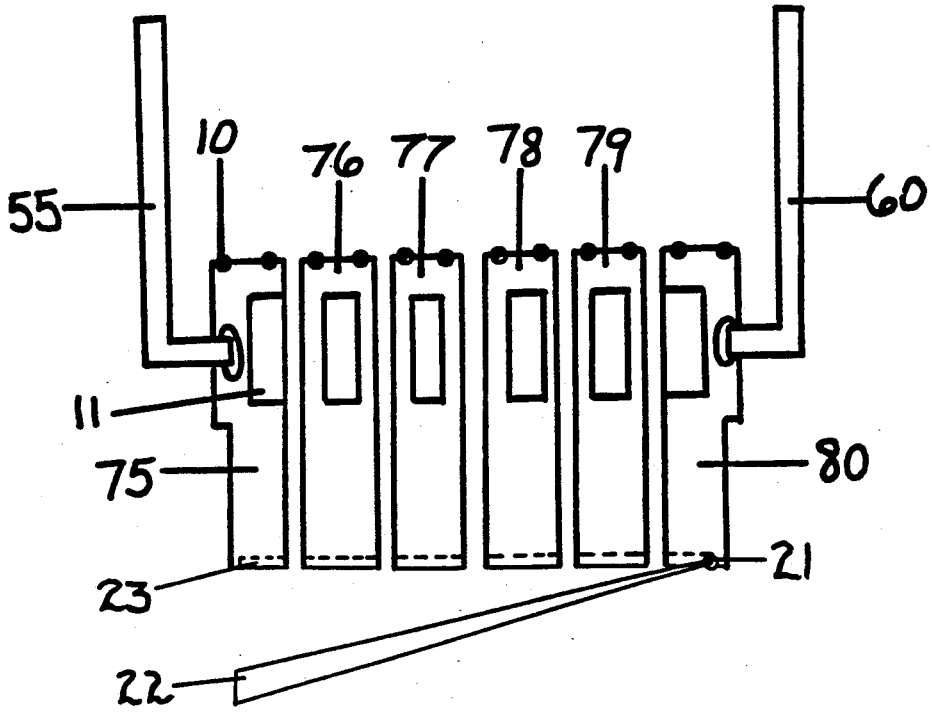
FIG. 6D is a top view of an embodiment for a first joining method applied to six separate base plates.
Figure 6E:
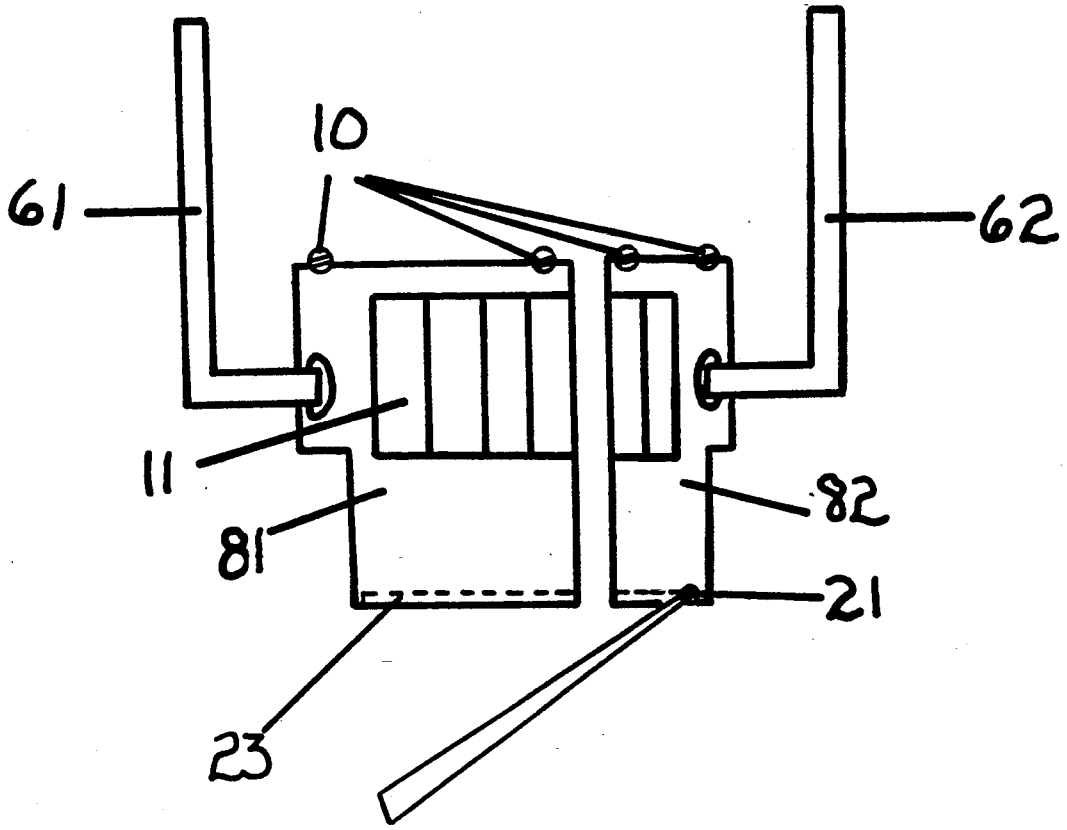
FIG. 6E is a top view of an embodiment for a first joining method applied to two separate base plates $\frac{1}{3}$–$\frac{2}{3}$ format.

FIGS. 6C, 6D, and 6E show top views similar to that of FIG. 6B for the embodiments of the present invention shown in FIGS. 2B, 2C and 2D.

Figure 7A:
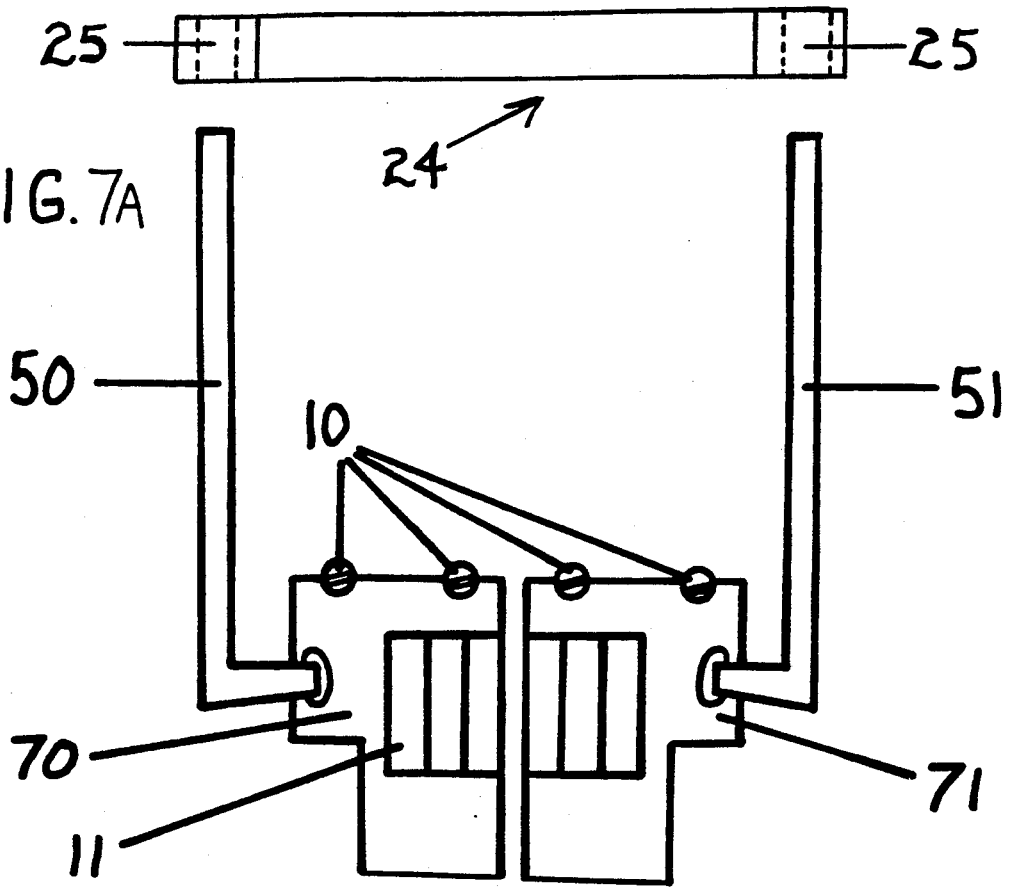
FIG. 7A is a top view of a an embodiment for a second joining method applied to two tremelo activation levers.

FIG. 7A shows a top view of a second joining method for base plates 70 and 71 of FIGS. 1A, 2A, and 5A. Base plates 70 and 71, a discussed above have tremelo activation levers 50 and 51 affixed thereto, respectively. The tips of the tremelo activation levers 50 and 51 may be joined by slipping channels 25 of joiner bar 24 over each of them. As can be seen in FIG. 7C, channels 25 are at opposite ends of joiner bar 24.

Figure 7B:
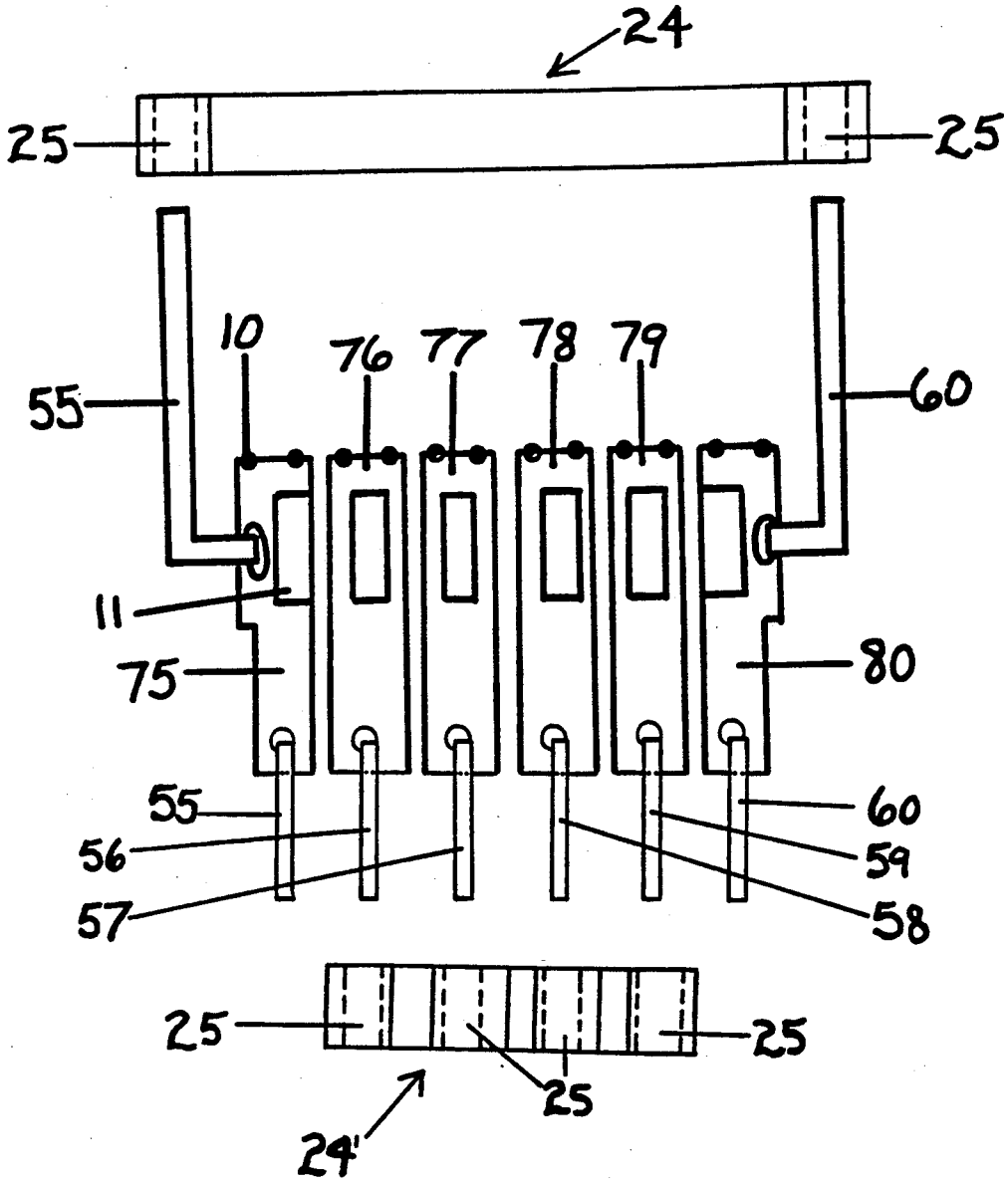
FIG. 7B is a top view of an embodiment for a second joining method applied to six tremelo activation levers.
Figure 7C:
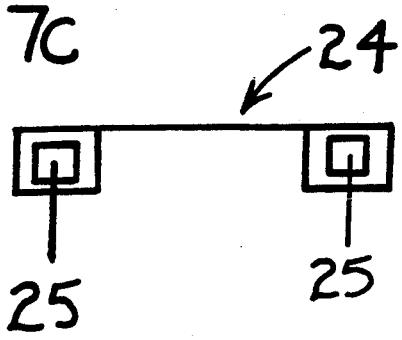
FIG. 7C is a top view of a front view of 24 from FIGS. 7A and 7B.

FIG. 7B shows the use of the second joining method where each string has its own base plate (see FIG. 2C). This figure illustrates the joining of tremelo activation levers 55–60 in two separate groups with a pair of joiner bars 24 and 24'. Tremelo activation levers 55 and 60 are joined in one group and tremelo activation levers 56–59 are joined in a second group. Tremelo activation levers 55–60 could similarly all be joined together or in other combinations of two or more groups.

Note for the second joining method the function without bar 24 rotating about the ends of levers 50 and 60, the ends of levers 50–60 have to have other than a round cross-section which match that of channels 25.

Figure 8A:
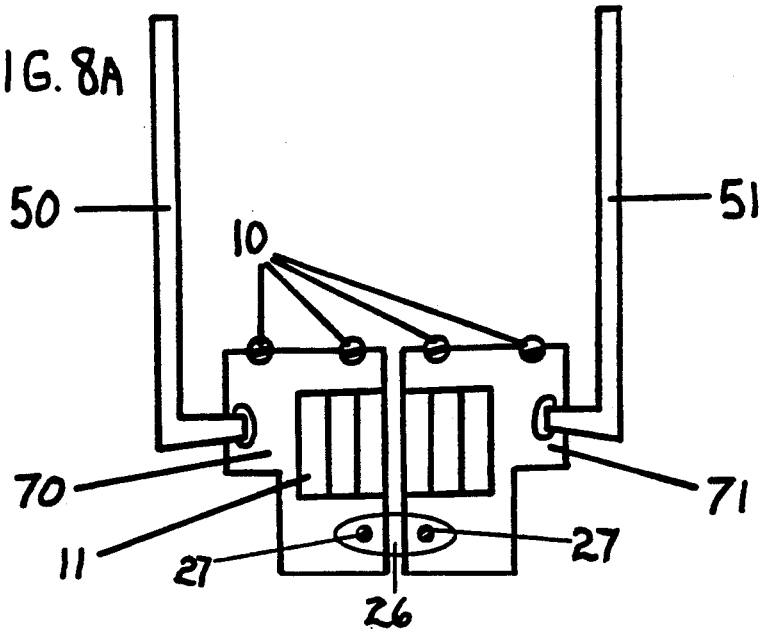
FIG. 8A is a top view of an embodiment for a third joining method applied to two separate base plates.
Figure 8B:
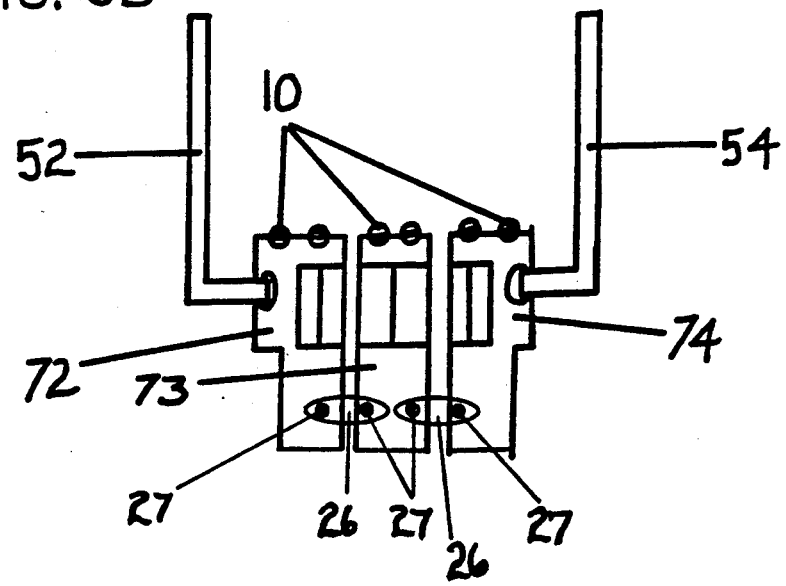
FIG. 8B is a top view of an embodiment for a third joining method applied to three separate base plates.
Figure 8C:
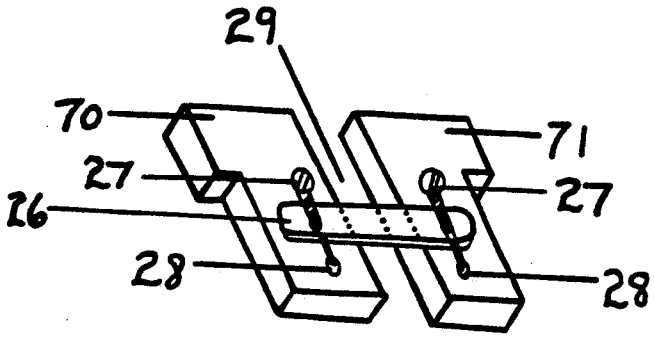
FIG. 8C is a partially exploded top view of an embodiment for a third joining method applied to two separate base plates.

FIGS. 8A and 8C, jointly, illustrate a third joining method for base plates 70 and 71 of FIGS. 1A, 2A, and 5A. Base plates 70 and 71 are shown joined as a single unit by joiner bar 26 which bridges gap 29 between base plates 70 and 71. Joiner bar 26 is attached to base plates 70 and 71 with a thumb screw 27 or other fastener, that extends through bar 26 into the surfaces of the base plates 70 and 71. Each of base plates 70 and 71 have hole 28 which is aligned with a hole in joiner bar 26 for mounting joiner bar 26 to each of base plates 70 and 71.

FIG. 8B further illustrates the use of the third joining method for base plates 72, 73 and 74 of FIGS. 1B, 2B, and 5B. The same principles as stated above for FIGS. 8A and 8C are easily extended to other combinations and numbers of base plates.

Figure 9A:
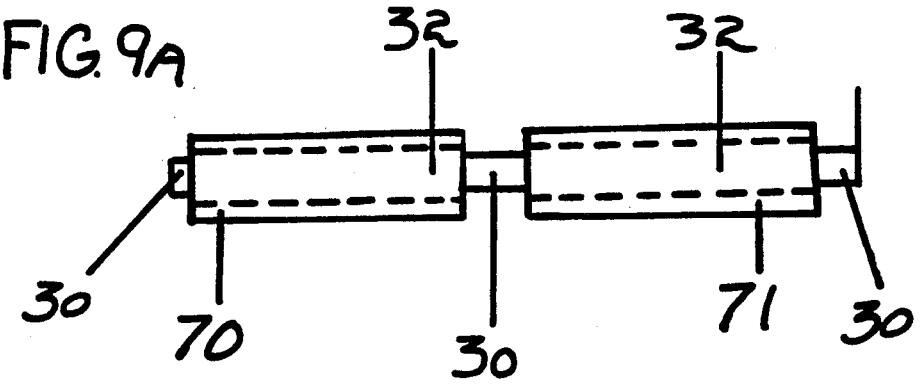
FIG. 9A is a rear view of an embodiment for a fourth joining method applied to two separate base plates.
Figure 9B:
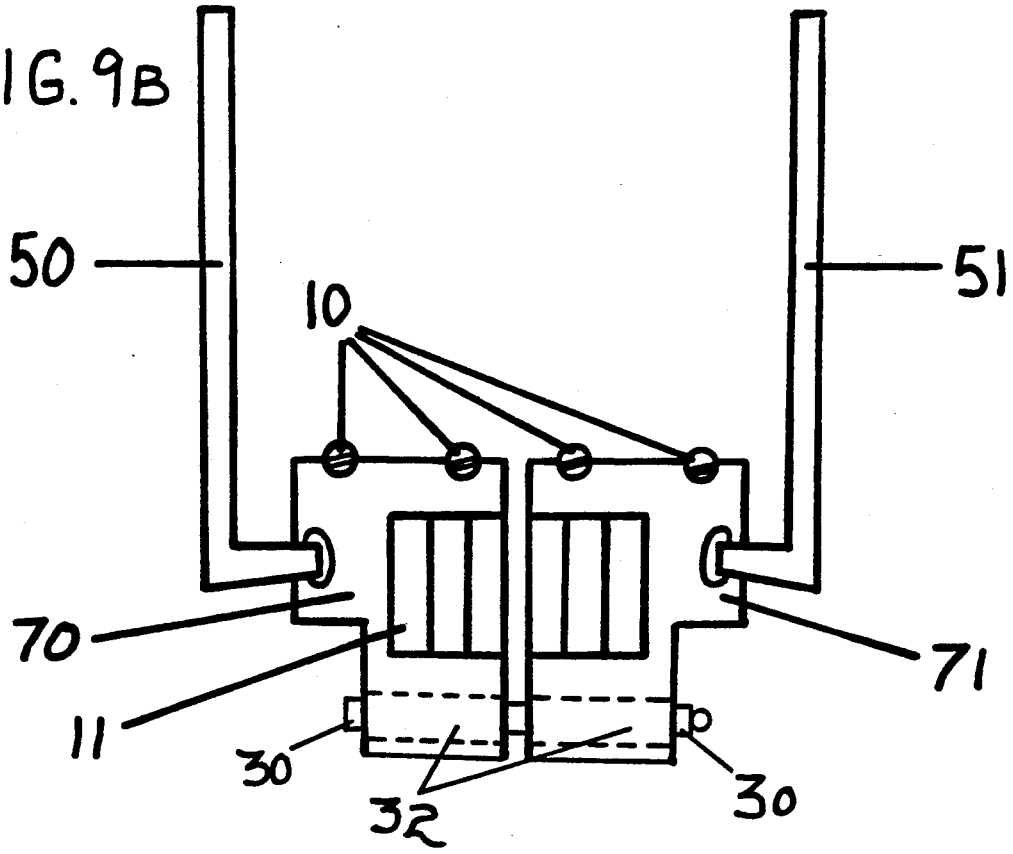
FIG. 9B is a top view of FIG. 9A.

FIGS. 9A and 9B show a rear and top view, respectively, of a fourth joining method for base plates 70 and 71 as seen in FIGS. 1A, 2A, and 5A. In this method, base plates 70 and 71 can be joined by sliding joiner bar 30 through a channel 32 in each of base plates 70 and 71.

Figure 9C:
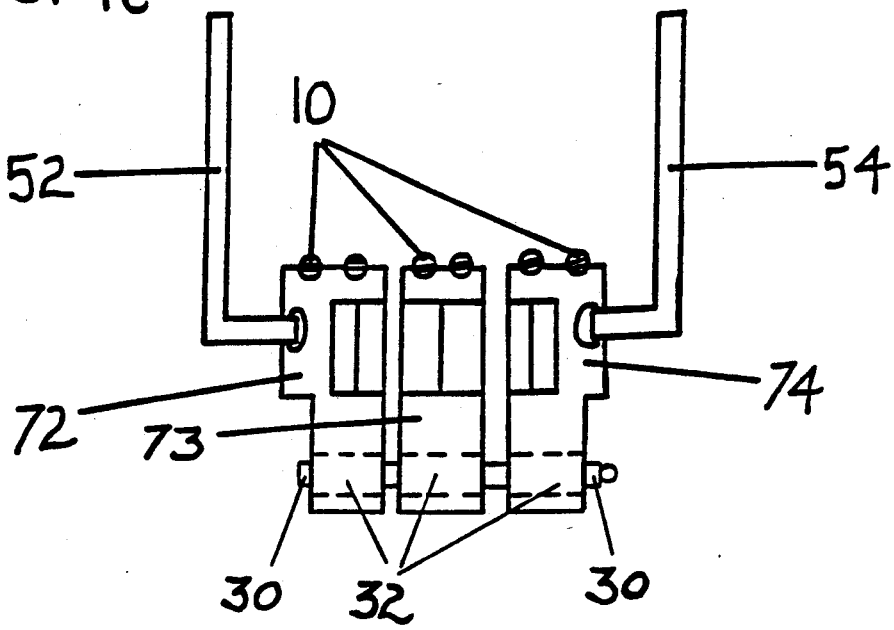
FIG. 9C is a top view of an embodiment for a fourth joining method applied to three separate base plates.
Figure 9D:
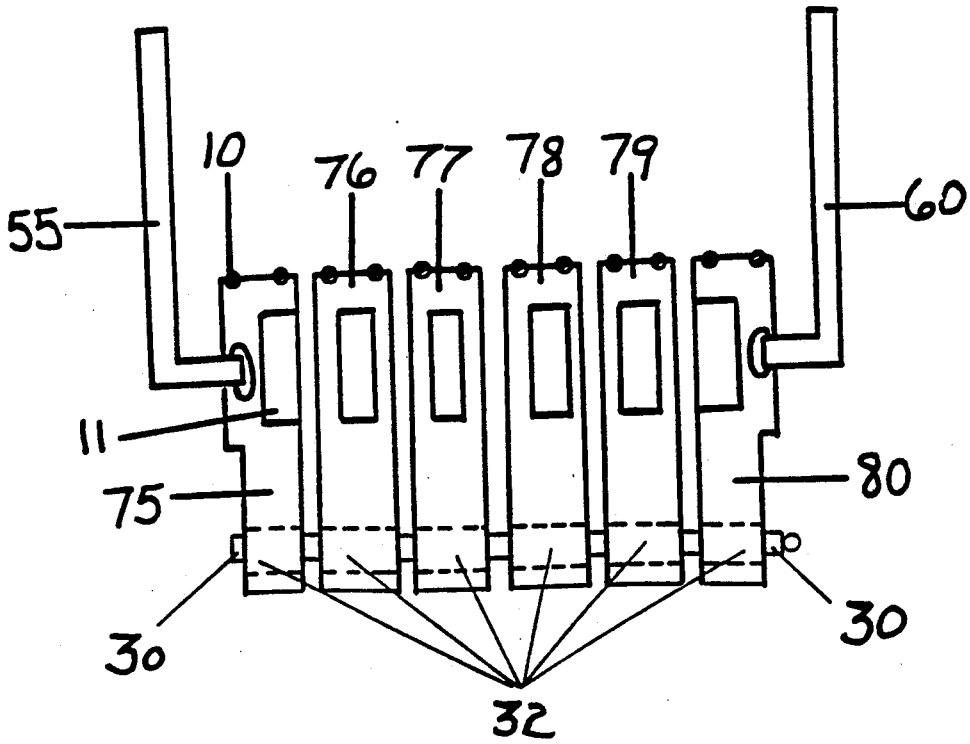
FIG. 9D is a top view of an embodiment for a fourth joining method applied to six separate base plates.

FIG. 9C and 9D show the extension of the method outlined in FIGS. 9A and 9B, situations where there are more than two base plates.

Figure 10A:
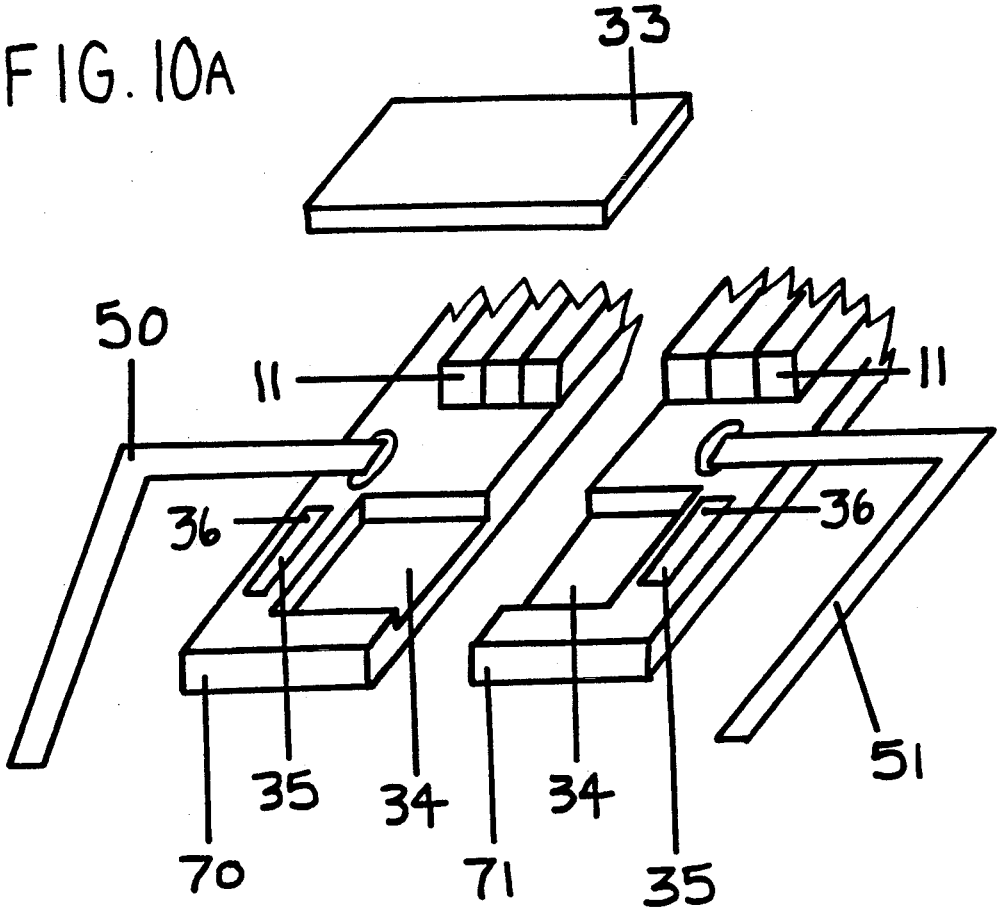
FIG. 10A is an enlarged perspective of an embodiment for a fifth joining method applied to two separate base plates.

FIG. 10A shows a fifth joining method for the base plates 70 and 71 of FIGS. 1A, 2A, and 5A. The base plates and 71 can be joined by placing joiner bar 33 into an opposing cavity 34 in each of base plates 70 and 71. Joiner bar 33 is then locked in each cavity 34 by rotating a latch 35 rotatably attached to each of the base plates over joiner bar 33. Latches 35 being rotatable around pin 36.

Figure 10B:
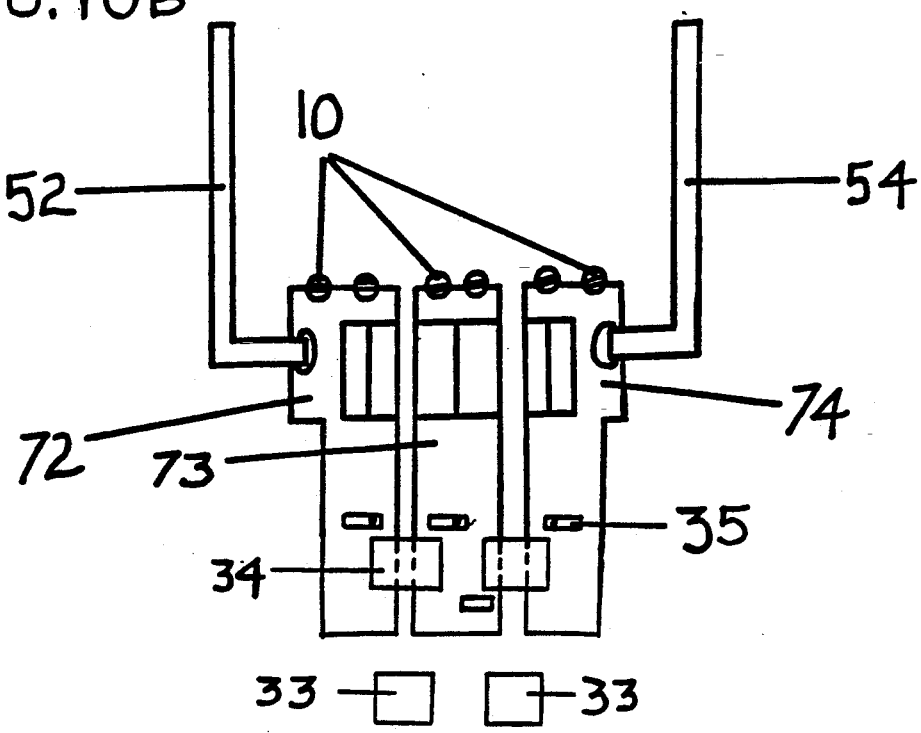
FIG. 10B is an exploded top view of an embodiment for a fifth joining method applied to three separate base plates.

FIG. 10B shows the extension of the fifth joining method to situations where there are more than two base plates.

Figure 11A:
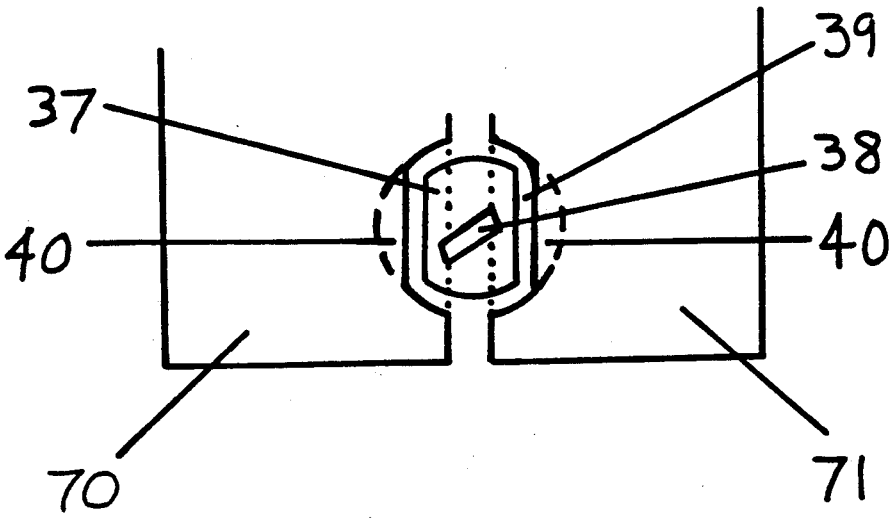
FIG. 11A is an enlarged top view of an embodiment for a sixth joining method applied to two of separate base plates.

FIG. 11A shows a top view of a sixth joining method for base plates 70 and 71 of FIGS. 1A, 2A, and 5A. Base plates 70 and 71, are shown being joinable by joiner bar 37. Bar 37 fits into a circular cavity 39 equally within the opposing edges of base plates 70 and 71. Cavity 39 includes a substantially rectangular central region with rounded ends which overlaps base plates 70 and 71, and an arcuate region 40 that extends into each of base plates 70 and 71 that is not open to the top or bottom of the base plates until the ends of joiner bar 37 are captured within arcuate regions of circular cavity 39. To join base plates 70 and 71, joiner bar 37 is rotated by knob 38.

Figure 11B:
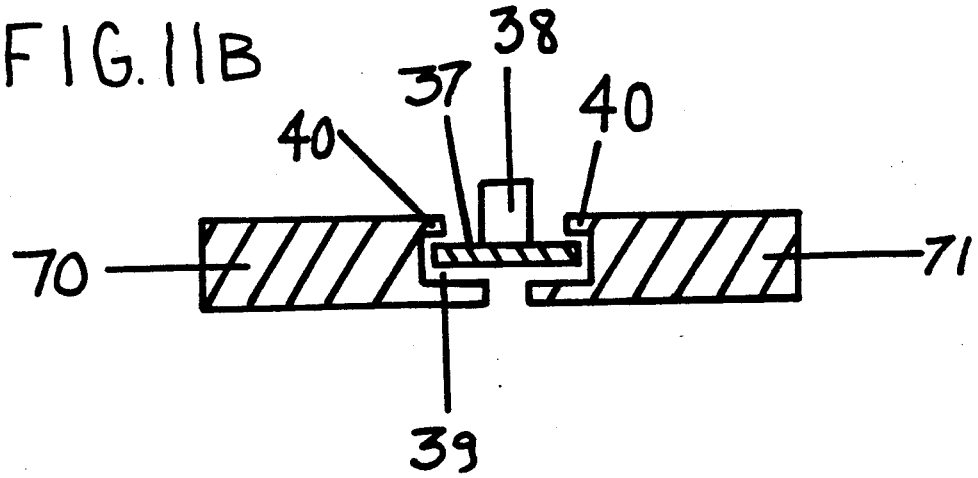
FIG. 11B is a cross-section of 11B from FIG. 11A.

FIG. 11B is a cross-section of cavity 37 with the ends of joiner bar 37 in the locked position within arcuate regions 40.

Figure 12A:
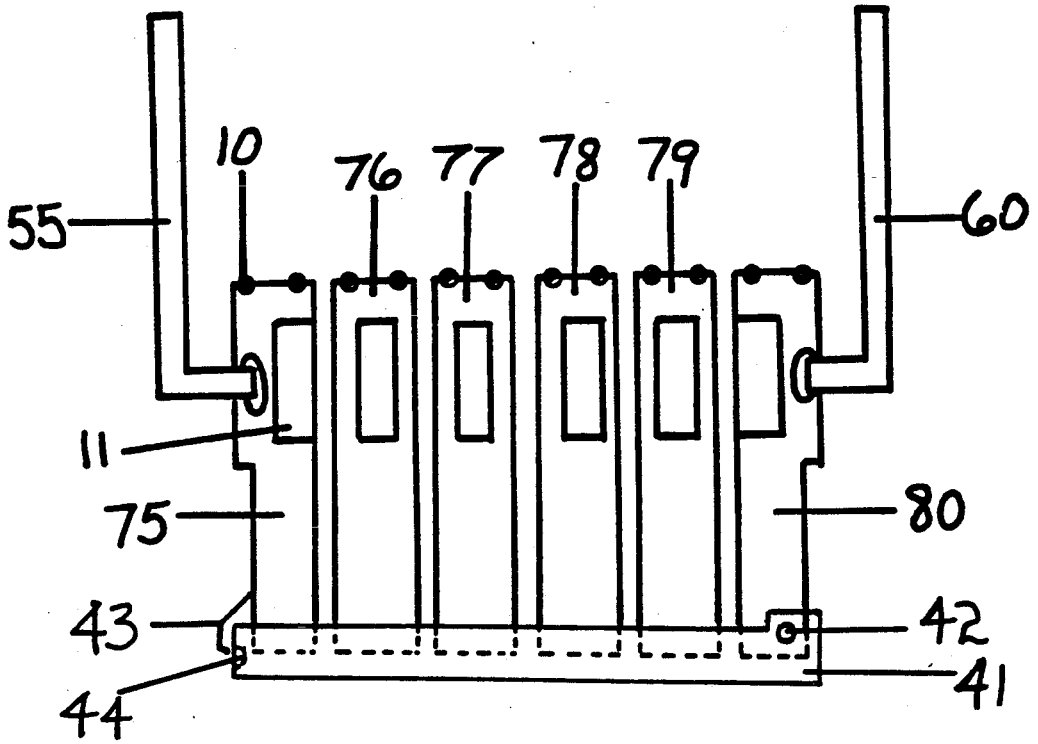
FIG. 12A is a top view of an embodiment for a seventh joining method applied to six separate base plates.

FIG. 12A shows a top view of a seventh joining method for the base plates 75–80 (FIG. 2C). Base plates 75–80 can be joined by slipping joiner cap 41 over the rear edges of base plates 75–80, with joiner cap 41 mounted on a hinge pin 42. Joiner cap 41, can be locked in place over the ends of base plates 75–80 by inserting a spring finger 43 attached to base plate 75 into dimple 44 in joiner cap 41.

Figure 12B:
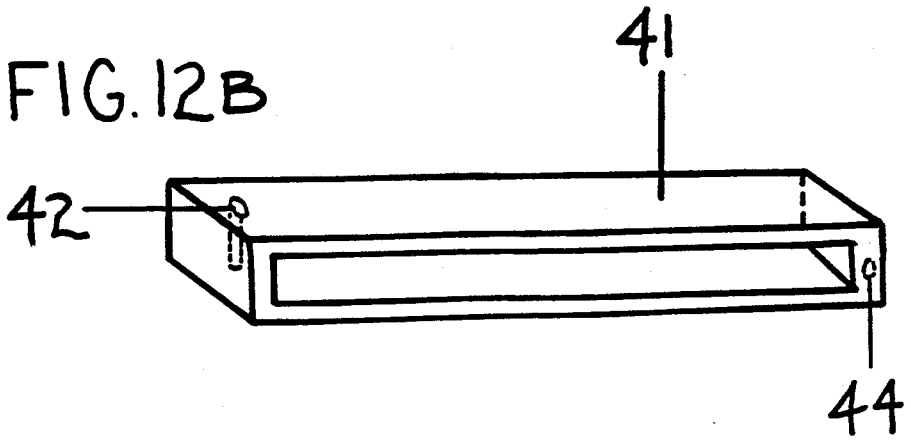
FIG. 12B is a perspective view of 41 from FIG. 12A.

FIG. 12B is a perspective view of joiner cap 41 of FIG. 12A that illustrates the cavity into which the ends of base plates 70–82 may slip.

Figure 13A:
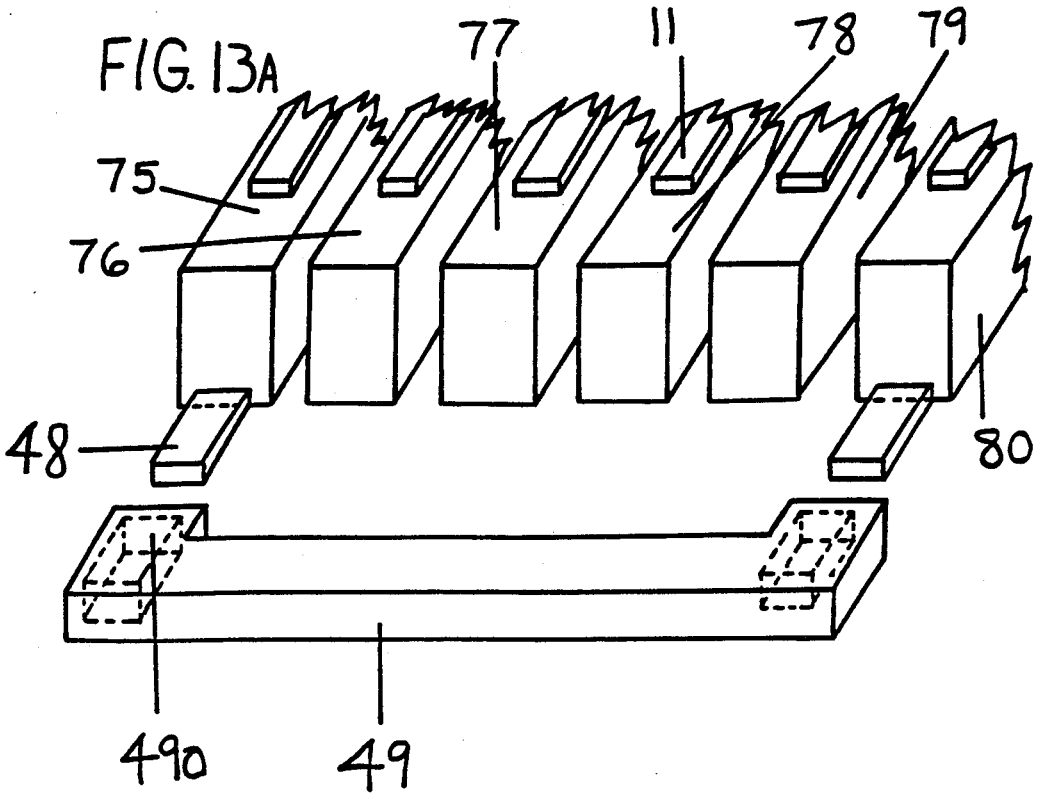
FIG. 13A is a perspective view of an embodiment for an eight joining method applied to six separate base plates.
Figure 13B:
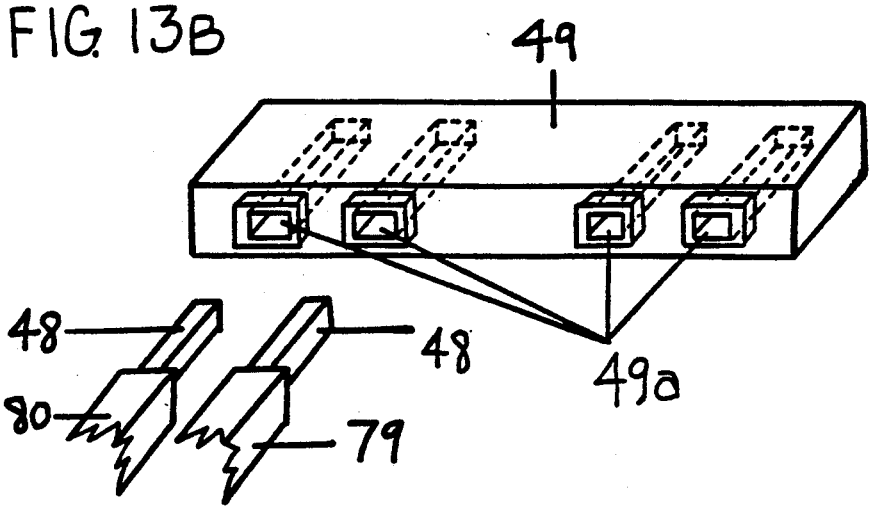
FIG. 13B is an enlarged perspective view of 49 from FIG. 13A.

FIGS. 13A and 13B show a perspective view of an eighth joining method for the base plates 75–80 of FIGS. 1C, 2C, and 5C. The outer base plates 75 and 80 may be joined by mating female receptacles 49*a* of joiner bar 49 with the male receptors 48, which extend out from the rear edge of base plates 75 and 80. By sliding the male receptors 48 into the female receptacles 49*a*, you now have joined the outer base plates 75 and 80.

Figure 13C:
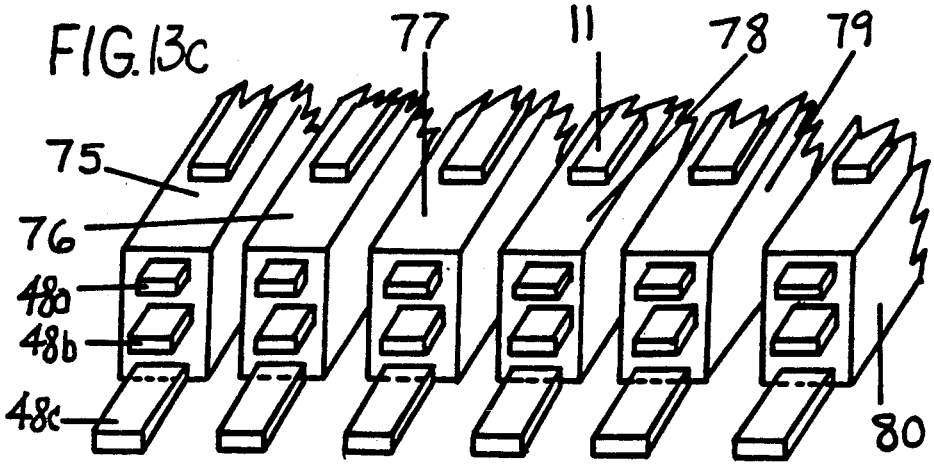
FIG. 13C is an enlarged rear view of the male receptors in an embodiment with six base plates.
Figure 13D:
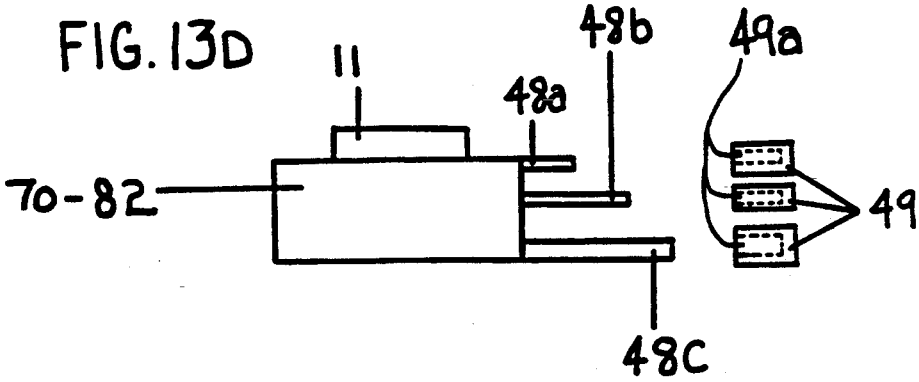
FIG. 13D is a partially exploded side view of an embodiment for an eighth joining method applied to all combinations of base plates.

FIGS. 13C and 13D, jointly, show the eighth joining method as seen in FIG. 13A, carried a step further. Here there is shown several levels of male receptors 48*a*, 48*b*, and 48*c* extending out from each of base plates 75–80 to enable one to do multiple unions of base plates 70–82. The male receptors 48*a*, 48*b* and 48*c* are shown at different levels on each base plate 70–82 as well as each level of male receptor 48*a*, 48*b*, and 48*c* having a different length. For example, the top male receptor 48*a* is the shortest in length; the middle male receptor 48*b* is intermediate in length; and the bottom male receptor 48*c* is the longest in length. This size change is done so there is no conflict between each joiner bar 49 when there are several unions of base plates 70–82 at the same time.

Figure 13E:
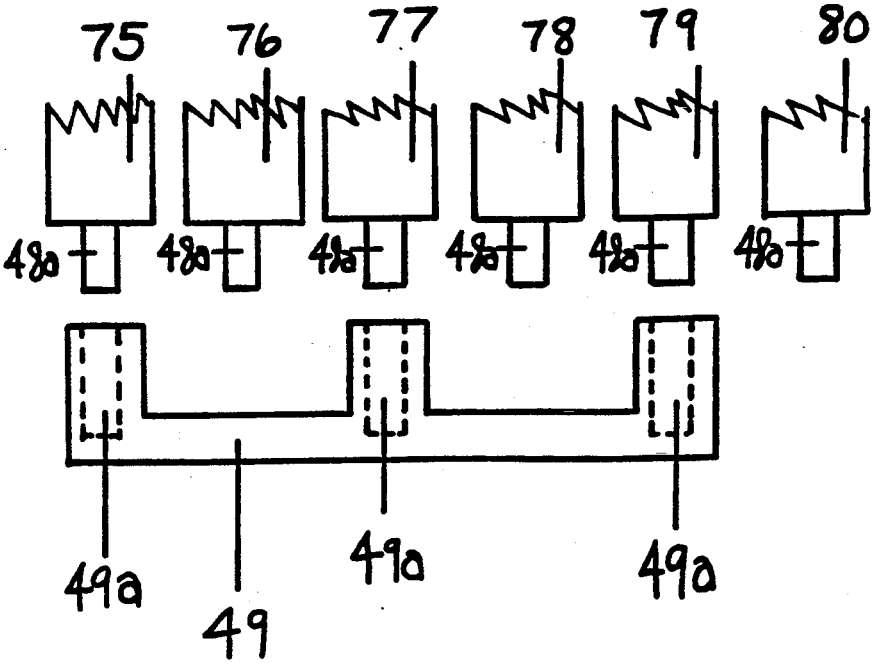
FIG. 13E is a partially exploded top view of an embodiment for an eighth joining method applied to three of six separate base plates.

FIG. 13E shows the use of the eighth joining method for joining base plates 75, 77 and 79. There is clearance between the female receptacles 49*a* of this variation of joiner bar 49 so that the male receptors 48*a*, which are not being used in a union, pass comfortably and are not obstructed by joiner bar 49. Since there are three levels of male receptors 48*a*, 48*b*, 48*c*, one could use a first joiner bar 49 to interconnect two or more base plates using the male receptors 48*a* on those base plates, a second group of base plates could be joined with a second joiner bar 49 mounted on the male receptors 48*b* on the selected base plates, and a third group of base plates can be similarly interconnected using the male receptors 48*c* on those base plates. This joiner method thus creates a great deal of versatility for the guitarist to generate various combinations of sounds that previously were not producable with conventional string instruments.

Thus, the above discussion and accompanying figures have illustrated the versatility of the present invention which provides the guitarist with the ultimate control over the sound patterns that can be created.

MUSICAL ADVANTAGES

At no time in history has technology stood still. Improvements have always controlled man's technological advancement. As with science, music has had many breakthroughs. Yet, for today's electric guitarists, there have been few breakthroughs in recent years. Due to this dilemma, it was not possible for many guitarists to create the sounds that they imagined in their heads. In contemplating the method to achieve those sounds, the present invention was created.

The present invention allows the musician the ability to:

1. Control the pitch of all strings individually.
2. Control the pitch of all strings simultaneously.
3. Control the pitch of different combinations of strings.
4. Selectively join various combinations of strings as a unit.
5. Allow musicians to choose the most convenient and comfortable activation lever (Tremelo Arm) to their playing style.

There are various aspects of the present invention which allow the musician to create favorable musical effects as well as improve the practical application of these effects. When musicians experiment and apply the present invention, these effects will be noticeable and favorable to those skilled in the art.

In his introduction to *Music And Your Emotions,* Published by Live Right, 1952, Emil A. Gutheil, M.D. states one reason experimenting is and has always been very important. Experimenting increases the mind's awareness of emotions. This is the basis for each human's growth and contribution to the source of their existence.

The emotional aspects of experimentation are not the only benefits of the present invention. The way these emotional benefits are realized is also an important aspect. In basic terms, you must listen in order to enjoy all of the benefits of the present invention. There are many questions, both positive and negative, which may be asked to evaluate each individual's response to the present invention. The guitarist, and people in general, may hear the present invention in a positive or negative manner. The main two questions are as follows:

1. Is the musician skilled in the art enough to produce positive effects, and
2. What does the listener actually hear and is their hearing ultra-sensitive or similar to the average of the overall population.

The answer to these questions is seen in the fact that the present invention does not require a high degree of skill and the music idioms it will most commonly be used in (Jazz, Fusion, Rock & Roll, etc.) already utilize and have accepted tremelo techniques and innovation within its principles. Innovation overall is actually a rule of those musicians who have been extremely successful in the Jazz, Fusion, and Rock & Roll fields.

The present invention has many benefits. One benefit is that it helps the musician to choose which tremelo activation lever is most comfortable to their playing style. The tremelo activation levers are positioned in a consecutive manner, downward, on the low E, next A, next D, next G, next B, and finally, next high E. Comfort and playing style will dictate not only advancement in dexterity at a consistent rate upward, but even help in eliminating fatigue in the forearm and finger tendons and muscles (a problem documented by Physicians and even treated, in some cases, with surgery) associated with playing a stringed instrument.

Another improvement is seen in the actual tuning of a tremelo device. It takes the guitarist more time to tune conventional tremelo devices. Conventional devices have a certain strain on the strings (lbs/in) and the guitarist must constantly tune each string consecutively until the strain on the strings stabilizes the bridge and the strings are in tune. The present invention, because less strings per bridge equals less strain on the bridge, makes the tuning process quicker and more efficient due to the principle previously stated.

Turning our attention now to the musical theory that is related to the actual production of sound by the present invention. The fact that frequency is actually part of the definition of pitch and the section from pages 116 through 118 of *The Acoustical Foundations of Music* by John Backus, Published by Norton, 1969, will need to be referenced in order to grasp the possible sounds that the present invention can create.

For example, you may take the low E and A strings as a unit and lower them an interval to D and G while taking the high E string and raising it an interval to F. This creates an alternate tuning and colors, on command, otherwise standard pitches with little effort.

For example, you may take the low E, the D, and the B strings as a unit and lower them two intervals to C, and B, and G, while leaving the A, G, and high E strings at their normal pitch of 440 cycles per second. Notice now there are two strings which are in the key of G, but one G is an octave above the other G. This again creates an alternate tuning and colors, on command, otherwise standard pitches with little effort.

The definition of consonance should be referenced to understand why, with proper application, the examples outlined above will produce proper and favorable musical effects.

What is claimed is:

1. A tremelo system for use on a stringed instrument having a body portion and a neck portion with the strings thereon connected between a bridge affixed to the body portion and thumbscrews at a distal end of the neck, said system comprising:
   - anchor means mounted to the body portion of said stringed instrument;
   - at least three tremelo base plate means each tiltably associated with separate portions of said anchor means;
   - resilient connection means between each of said tremelo base plates and the body of said stringed instrument for separately maintaining each tremelo base plate in a fixed position with relation to the body of the stringed instrument except when the individual tremelo base plate is activated;
   - bridge means for receiving at least one string mounted on each of said base plates;
   - a separate tremelo activation lever associated with each of said tremelo base plates;
   - nut means mounted on the distal end of the neck of said stringed instrument between said thumbscrews and the said bridge;
   - first string restraining means for adjustably clamping the strings to each of said bridge means;

second string retaining means for adjustably clamping the strings to said nut means; and joiner means for selective rigid connection of at least two of said tremelo base plates having at least one other tremelo base plate therebetween so that the joined tremelo base plates function as a single tremelo unit when activated by any one of their activation levers.

2. A method for providing a tremelo device in combination with a stringed instrument having a body portion and a neck portion with the strings thereon connected between a bridge affixed to the body portion and thumb screws at the distal end of the neck, said method comprising the steps of:

a. affixing anchor means to the body portion of said stringed instrument in a fixed relationship spaced above the body portion thereof;

b. mounting at least three tremelo base plates in association with separate portions of said anchor means in such manner that each base plate may separately tilt upon said anchor means;

c. providing a bridge for receiving at least one string on each of said base plates;

d. providing resilient connection means between each of said tremelo base plates and the body of the stringed instrument in such manner that each base plate will be separately maintained in a fixed position with relation to the body of the stringed instrument except when the individual tremelo base plate is activated;

e. providing a separate tremelo activation lever associated with each of said tremelo base plates;

f. providing nut means mounted on the distal end of the neck of said stringed instrument between said thumbscrews and the said bridge;

g. affixing a first string restraining means of adjustably clamping the strings to each of said bridge means;

h. affixing second string retaining means for adjustably clamping the strings to said nut means to prevent sliding of the strings with relation to the nut; and i. providing joiner means for selective rigid connection of at least two of said tremelo base plates of step b having at least one other tremelo base plate therebetween so that the joined tremelo base plates function as a single tremelo unit when activated by any one of their activation levers of step e.

* * * * *